US006522302B1

(12) United States Patent
Iwasaki

(10) Patent No.: US 6,522,302 B1
(45) Date of Patent: Feb. 18, 2003

(54) CIRCULARLY-POLARIZED ANTENNAS

(75) Inventor: Tatsuhiko Iwasaki, Nishinomiya (JP)

(73) Assignee: Furuno Electric Co., Ltd., Hyogo (JP)

( * ) Notice: Subject to any disclaimer, the term of this patent is extended or adjusted under 35 U.S.C. 154(b) by 0 days.

(21) Appl. No.: 09/979,696

(22) PCT Filed: Oct. 21, 1999

(86) PCT No.: PCT/JP99/05822

§ 371 (c)(1),
(2), (4) Date: Nov. 6, 2001

(87) PCT Pub. No.: WO00/69022

PCT Pub. Date: Nov. 16, 2000

(30) Foreign Application Priority Data

May 7, 1999 (JP) ..... 11-126958

(51) Int. Cl.[7] ..... H01Q 21/00

(52) U.S. Cl. ..... 343/726; 343/725; 343/866; 343/797

(58) Field of Search ..... 343/726, 725, 343/727, 728, 729, 730, 866, 797, 795, 793; H01Q 21/00

(56) References Cited

U.S. PATENT DOCUMENTS 3,475,687 A * 10/1969 Pierce ..... 343/795
5,173,715 A * 12/1992 Rodal et al. ..... 343/795
5,568,162 A * 10/1996 Samsel et al. ..... 343/842

* cited by examiner

*Primary Examiner*—Hoanganh Le
(74) *Attorney, Agent, or Firm*—Pillsbury Winthrop LLP

(57) ABSTRACT

Terminal ends at one side of first and second elements 2*a*, 2*b* whose length is approximately half the wavelength of radiated radio wave are used as first feeding points #1, #2 and terminal ends at the other side of the individual elements are connected to a loop-shaped element 1 whose perimeter is approximately equal to the wavelength at two oppositely located points of four equally dividing points of the loop-shaped element 1. Terminal ends at one side of third and fourth elements 2*c*, 2*d* whose length is approximately half the wavelength of the radiated radio wave are used as second feeding points #3, #4 and terminal ends at the other side of the individual elements are connected to the remaining two oppositely located points. Electric power is fed into the first and second feeding points with a phase difference of 90°. This structure makes it possible to obtain a small-sized circularly polarized antenna which offers a favorable axial ratio over a wide angle and electrically switches the hand of polarization.

11 Claims, 22 Drawing Sheets

13a,13b: EXCITATION SOURCE

CIRCULARLY-POLARIZED ANTENNAS

TECHNICAL FIELD

The present invention relates to circularly polarized antennas.

BACKGROUND ART

With proliferation of the use of communications satellites in recent years, there is a growing demand for circularly polarized antennas having good axial ratio characteristics and a hemispherical radiation pattern.

Conventionally, cross dipole antennas as shown in FIG. 21 have been used as one typical form of circularly polarized antennas.

Referring to FIG. 21, designated by the numerals 12*a*, 12*b*, 12*c*, 12*d* are elements of cross dipoles. The elements 12*a*, 12*b* are fed from an excitation source 13*a* while the elements 12*c*, 12*d* are fed from an excitation source 13*b*, wherein there is a 90° difference in exiting phase between the two excitation sources 13*a*, 13*b*. The directions of the elements 12*a*-12*b* and the elements 12*c*–12*d* intersect each other at right angles. Accordingly, this cross dipole antenna produces circularly polarized waves in a direction perpendicular to a plane containing the two dipoles.

The aforementioned cross dipole antenna produces circularly polarized waves in its frontal direction (the direction perpendicular to the plane containing the two dipoles). However, the waves gradually become elliptically polarized waves toward sideways directions, and become linearly polarized waves on the plane containing the two dipoles.

As another typical circularly polarized antenna, a four-wire fractional winding helical antenna as shown in FIG. 22 is also used conventionally. Referring to FIG. 22, designated by the numerals 22*a*, 22*b*, 22*c*, 22*d* are elements of the four-wire fractional winding helical antenna, and designated by the numerals #1 to #4 are feeding points at the terminal ends of the elements. In this example, the number of turns is 0.5, which means that each element is wound, with its length from one end to the other, around a cylindrical surface as much as half its circumference. With the four-wire fractional winding helical antenna having such a structure, left-handed circularly polarized wave is obtained when the elements are wound clockwise as viewed from their feeding points to terminal ends, whereas right-handed circularly polarized wave is obtained when the elements are wound in the opposite direction (counterclockwise). Further, the direction of radiation is determined by winding method of the elements and the relation of phase of feeding to the four feeding points.

Although the structure of the four-wire fractional winding helical antenna of this kind is more or less complicated as compared to the cross dipole antenna, it is possible to obtain a favorable axial ratio over a wide angle.

One typical example of a circularly polarized antenna is a conical log spiral antenna. This antenna has spiral-shaped elements arranged on a conical surface. A four-wire conical log spiral antenna, for example, has a number of parameters due to its structure and can create various forms of radiation directivity by the choice of these parameters. As such, the four-wire conical log spiral antenna exhibits almost the same characteristics as the aforementioned four-wire fractional winding helical antenna.

In the aforementioned four-wire conical log spiral antenna and conical log spiral antenna, however, the hand of polarization (right-handed or left-handed) of the circularly polarized wave is determined by the winding direction of the elements unlike the cross dipole antenna, so that it has been extremely difficult to electrically switch the hand of polarization.

When transmitting and receiving circularly polarized waves having different hands of polarization at the same or nearby frequencies, for example, it has been necessary to provide separate antennas dedicated exclusively to the right-handed and left-handed circularly polarized waves.

Also for a recent satellite-based mobile communications antenna, a compact antenna smaller than the currently available four-wire fractional winding helical antenna and conical log spiral antenna is required.

Although it is possible to decrease the overall physical size of either the four-wire fractional winding helical antenna or the conical log spiral antenna by reducing the number of turns, there has been a problem that an angular range in which a specific axial ratio can be maintained decreases in exchange for the reduction in antenna size.

It is an object of the invention to provide a circularly polarized antenna having a favorable axial ratio over a wide angle despite its compactness.

It is another object of the invention to provide a circularly polarized antenna which makes it possible to electrically switch the hand of polarization.

DISCLOSURE OF THE INVENTION

A circularly polarized antenna of this invention comprises a loop-shaped element whose perimeter is approximately equal to the wavelength of radiated radio wave, and four elements extending upward from the loop-shaped element whose terminal ends or points near the terminal ends at one side are connected to the loop-shaped element at its four equally dividing points, feeding points being provided at the opposite terminal ends of the four elements, and the length of each of the four elements being approximately equal to half the wavelength of the radiated radio wave.

FIGS. 1A–1C are diagrams showing an example of the aforementioned circularly polarized antenna. In FIG. 1A, designated by the numeral 1 is a loop-shaped element and designated by the numerals 2*a*–2*d* are first to fourth elements. Also, designated by #1–#4 are feeding points of the individual elements 2*a*–2*d*. As depicted in FIG. 1B, excitation sources 3*a* and 3*b* are connected to the feeding points #1–#2 which serve as first balanced feeding points and to the feeding points #3–#4 which serve as second balanced feeding points, respectively. There is a phase difference of approximately 90° between currents fed from these excitation sources 3*a*, 3*b*. In this example, the upper ends of the elements are used as the feeding points.

FIGS. 1A and 1B show examples in which one end of each of the first to fourth elements 2*a*–2*d* is connected to a corresponding one of four equally dividing points of the loop-shaped element and the feeding points are provided at the other ends. FIG. 1C shows an example in which the loop-shaped element 1 is connected points close to ends of the elements.

The circularly polarized antenna having such a structure exhibits characteristics generally equivalent to a four-wire fractional winding helical antenna or a conical log spiral antenna due to its operational effects described below.

Specifically, by exhibiting the operational effects equivalent to the four-wire fractional winding helical antenna or the conical log spiral antenna, the present invention achieves antenna characteristics equivalent to those antennas and, yet, solves drawbacks of the four-wire fractional winding helical antenna or the conical log spiral antenna.

FIGS. 2A–2C show current distributions on two elements of four-wire fractional winding helical antennas, of which FIG. 2A is a current distribution diagram showing a state in which paired two of the four elements fed by one excitation source are extended in a linear form. Here, the one element is expressed by 0.75λ where λ is the wavelength of the radiated radio wave.

FIG. 2B is a side view showing a state in which the elements shown in FIG. 2A are wound in a helical form and FIG. 2C is a top view of the same. In this example, the number of turns is set to 0.5, which means that each element is wound as much as half the circumference of a cylindrical surface.

This invention configures a new antenna which exhibits approximately the same current distribution as that on the paired two elements as they are wound in a helical form.

Let us now focus on a current distribution on portions beneath the feeding points. In the current distribution on helically wound portions of the two elements, maximum current is observed at approximately the middle of each element and the current flowing in these portions is considered to be important for antenna characteristics. Although the helically wound portions of the two elements are spaced at some distance apart, the distance between them (or the diameter of the helical shape) is sufficiently small compared to the wavelength and, therefore, it is assumed that the current on the portions beneath the feeding points can be approximated by the vector sum of currents flowing through the proximity of the maximum current points in the helically wound portions of the two elements. (To obtain a vector sum, the initial points of its two constituent vectors need to coincide with each other in principle.)

Therefore, to configure an antenna equivalent to the helical antenna formed by these two elements, it is preferable to provide an object through which a current of the same phase as the excitation source flows in the same direction as the current fed from the excitation source in the proximity of the maximum current points.

While the foregoing discussion has dealt with a case in which an antenna equivalent to the helical antenna is configured by the two elements, it is also possible to obtain a four-wire fractional winding helical antenna by approximation by providing two pairs of elements in such a way that the two pairs intersect each other at 90° and by feeding them currents with a phase difference of 90°. What is important here is how to configure the aforementioned object. In this invention, the inventor considered a cross dipole antenna excited by excitation sources 3*a*, 3*b* as shown in FIG. 3A, and studied how to configure an object through which a current of the same phase as a current fed from the excitation source 3*a* flows in the same direction as the current flowing near the feeding point from the excitation source 3*a*, and through which a current of the same phase as a current fed from the excitation source 3*b* flows in the same direction as the current flowing near the feeding point from the excitation source 3*b*, at positions spaced downward from the feeding points by a specific distance and spaced horizontally by a distance equal to the radius of the helical shape.

The inventor has consequently reached an extremely simple structure for providing the aforementioned object. Specifically, as shown in FIG. 3B, a loop-shaped element whose perimeter is equal to wavelength λ is employed and the feeding points are connected to four equally dividing points of the loop-shaped element by elements whose length is approximately equal to λ/2 (half the wavelength).

FIG. 4 shows to which points of the aforementioned two elements 2*a*, 2*b* the loop-shaped element 1 should be connected.

In this Figure, the length of each of the four elements is made equal to 0.75λ in the same way as in the case of the four-wire fractional winding helical antenna, where in current distribution on each element is shown by a thin line and voltage distribution is shown by a broken line. As can be seen from the Figure, points on the elements separated by 0.5λ from the feeding points become equivalent short-circuit points. Since the input impedance of the loop-shaped element 1 is low, it is possible to achieve impedance matching if the loop-shaped element 1 is connected to the points separated by approximately 0.5λ from the feeding points.

As the elements 2*a*, 2*b* constituting one element pair are not wound in a helical form but two points located opposite each other of the loop-shaped element 1 are connected to terminal parts of the elements 2*a*, 2*b*, a current flows through the loop-shaped element 1 in the same direction as the current flowing near the feeding point from the excitation source 3*a*. Moreover, since the distance from the feeding points of the elements 2*a*, 2*b* to the connecting points of the loop-shaped element is made approximately equal to half the wavelength, a current of the same phase as the current fed from the excitation source 3*a* flows in the loop-shaped element.

FIG. 4 shows to which points of the elements 2*a*, 2*b* the loop-shaped element 1 should be connected. Portions of the elements 2*a*, 2*b* from their points connected to the loop-shaped element 1 up to their extreme ends are not necessary for feeding currents to the loop-shaped element 1. Since the currents flowing in the aforementioned portions are oppositely directed, these portions are rather useless for the antenna. Thus, the elements 2*a*, 2*b* would be long enough if their length corresponds to the extension from the excitation source 3*a* to the points connected to the loop-shaped element 1 (approximately 0.5λ).

In the case of the four-wire fractional winding helical antenna, the element length from the feeding point to the terminal end of each element is approximately 0.75λ. In contrast, the element length from the feeding point to the terminal end of each element is approximately 0.5λ in the aforementioned structure, so that the element length is reduced to about two thirds compared to the four-wire fractional winding helical antenna, resulting in a reduced overall antenna size.

While FIG. 4 shows how the elements 2*a*, 2*b* constituting one element pair are connected to the loop-shaped element, two points on the loop-shaped element offset from the aforementioned connecting points by 90° in terms of rotational angle and electrical phase angle are connected to the terminal ends of the elements 2*c*, 2*d* constituting the other element pair as shown in FIG. 3B. As a result, a current having approximately the same phase as the phase of the current fed from the excitation source 3*b* flows in the same direction as the current flowing near the feeding point from the excitation source 3*b*.

FIG. 5 shows changes with time of the direction of the current flowing through the aforementioned loop-shaped element. While distribution of the current flowing through the loop-shaped element whose impedance is matched to that of the aforementioned four elements is not necessarily clear, it is expected that the direction of the current cyclically varies with time according to cycles of a transmitting signal as illustrated in FIG. 5.

The circularly polarized antenna of the invention further comprises a reflector plate provided at a position separated from the aforementioned loop-shaped element by a specific distance, the reflector plate being disposed parallel to the loop-shaped element.

With this structure, radio wave having an opposite rotating direction radiated from the feeding points toward the loop-shaped element is reflected by the reflector plate and radiated back as a circularly polarized wave having a specific rotating direction. This helps eliminate directivity in undesired directions and increase gain in a specific direction.

The circularly polarized antenna of the invention further comprises baluns connected to the aforementioned feeding points for performing mode conversion between unbalanced transmission mode and balanced transmission mode. With this structure, electric power can be fed by use of the baluns.

In the circularly polarized antenna of the invention, the aforementioned baluns are formed on a reverse side of the aforementioned reflector plate. This makes it easier to, configure the baluns in a broad area separated from the four elements and to feed electric power to the feeding points in the balanced transmission mode.

The circularly polarized antenna of the invention further comprises a first substrate on which a conductor pattern constituting parts of the aforementioned four elements is formed, a second substrate disposed parallel to the first substrate with a conductor pattern constituting the aforementioned loop-shaped element formed on the second substrate near its outer periphery, and a cylindrical substrate joining the first and second substrates to each other with a conductor pattern constituting the remaining parts of the aforementioned four elements formed on the cylindrical substrate. Alternatively, the aforementioned loop-shaped element is provided on the aforementioned cylindrical substrate and not on the second substrate.

By configuring the aforementioned individual elements by the first and second substrates and a cylindrical substrate, it becomes easier to configure the individual elements and to retain them in specific shapes.

In the circularly polarized antenna of the invention, the aforementioned baluns are provided on the aforementioned first substrate. This serves to facilitate the manufacture of the baluns and decrease variations in their characteristics.

The circularly polarized antenna of the invention may comprise a plurality of substrates standing in approximately a vertical position and intersecting one another with the aforementioned four elements configured by conductor patterns formed on these substrates. This makes it easier to configure the four elements and retain them in specific shapes.

The circularly polarized antenna of the invention may comprise a flexible substrate on which a beltlike conductor pattern is formed or a beltlike metal plate for sequentially joining edges of the aforementioned multiple substrates and configuring the aforementioned loop-shaped element. This makes it easier to configure the loop-shaped element and simplifies the structure for keeping it in a specific shape.

BEST MODES FOR CARRYING OUT THE INVENTION

An example of the structure of a circularly polarized antenna according to a first embodiment of the invention is now described with reference to FIGS. 6 to 8.

Figure 6:
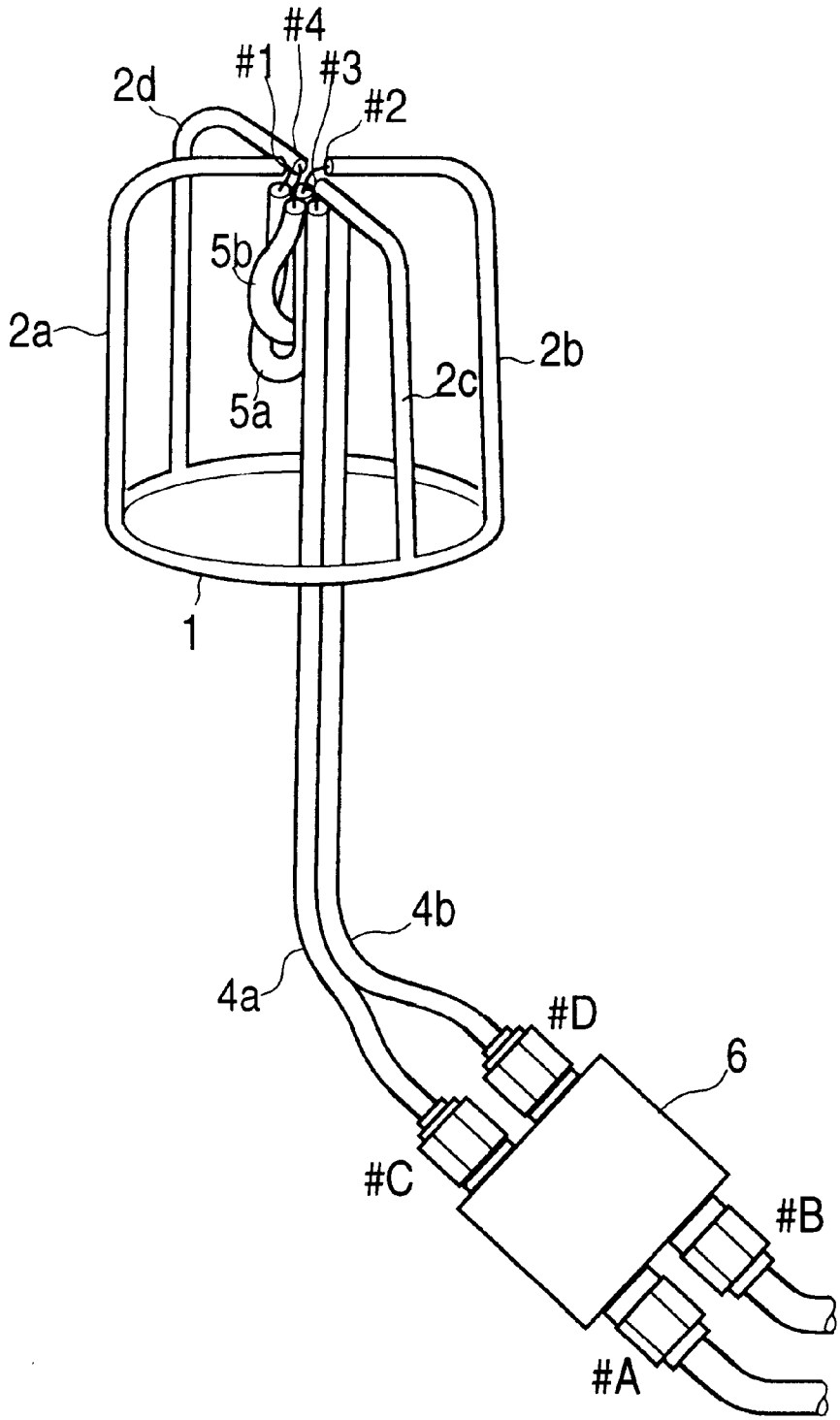
FIG. 6 is a diagram showing the structure of a circularly polarized antenna according to a first embodiment.

FIG. 6 is a perspective view showing the circularly polarized antenna together with its feeder system, in which designated by the numerals 2*a*–2*d* are first to fourth elements. One end #1–#4 of each element serves as a feeding point, and the other end is connected to one of four equally dividing points of a loop-shaped element 1. The wavelength of radiated waves is 137 mm (2.185 GHz), the length of the individual elements 2*a*–2*d* is 62 mm, and the length (circumference) of the loop-shaped element 1 is 152 mm.

A first balun 5*a* is connected to the feeding points #1–#2, a second balun 5*b* and terminal ends of semirigid coaxial cables 4*a*, 4*b* are connected to the feeding points #3–#4.

Figure 7:
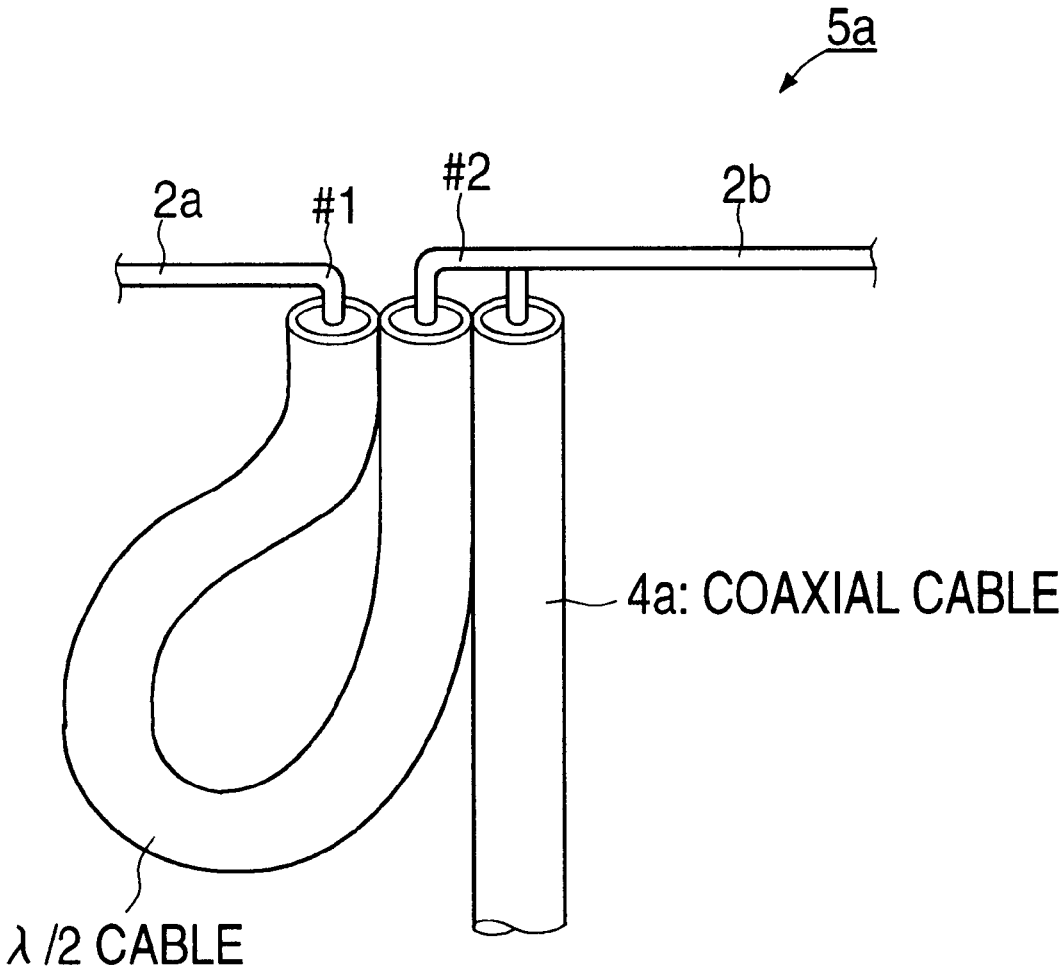
FIG. 7 is a diagram showing the structure of a balun used in the aforementioned antenna.

FIG. 7 is a diagram showing the structure of the aforementioned first balun 5*a*. This balun is of a type that is so called as the U-balun or 4:1 balun. One end of the coaxial cable 4*a* is connected to the feeding point #2, and a center conductor of a coaxial cable (semirigid cable) whose length is equal to λ/2 is connected between the two feeding points #1–#2. Both ends of an outer conductor of this λ/2 cable and an outer conductor of the coaxial cable 4*a* are electrically connected. The aforementioned second balun 5*b* has the same structure as described above. Mode conversion between balanced transmission mode and unbalanced transmission mode is performed and impedance matching between 200-ohm and 50-ohm lines is made with this structure. Therefore, if the characteristic impedance as viewed from the feeding points #1–#2 is 200 ohms, impedance matching is achieved by the use of a coaxial cable whose impedance is 50 ohms. Since the impedance of the circularly polarized antenna shown in FIG. 6 is approximately 200 ohms by chance, it is possible to use an ordinary coaxial cable whose characteristic impedance is 50 ohms.

Referring to FIG. 6, designated by the numeral 6 is a 3 dB directional coupler. Provided that its ports #A and #B are input ports and its ports #C and #D are output ports, and if a terminal resistor is connected to the port #B and a transmitting signal is fed into the port #A, signals carrying equally distributed electric power are output from the ports #C and #D. In this case, the signal output from the port #D is delayed in phase by as much as λ/4 from the signal output from the port #C. Also, if a terminal resistor is connected to the port #A and a transmitting signal is fed into the port #B, signals carrying equally distributed electric power are output from the ports #C and #D. In this case, the signal output from the port #C is delayed in phase by as much as λ/4 from the signal output from the port #D.

Therefore, right-handed circularly polarized radio wave is radiated upward as illustrated (in the direction from the loop-shaped element 1 toward the feeding points #1–#4) by feeding the transmitting signal into the port #A. Likewise, left-handed circularly polarized radio wave is radiated upward as illustrated (in the direction from the loop-shaped element 1 toward the feeding points #1–#4) by feeding the transmitting signal into the port #B.

According to the reciprocity theorem on antennas, if the port #A is used as an output port for a received signal, the circularly polarized antenna works as a receiving antenna for right-handed circularly polarized wave and, conversely, if the port #B is used as an output port for a received signal, the circularly polarized antenna works as a receiving antenna for left-handed circularly polarized wave.

Figure 8:
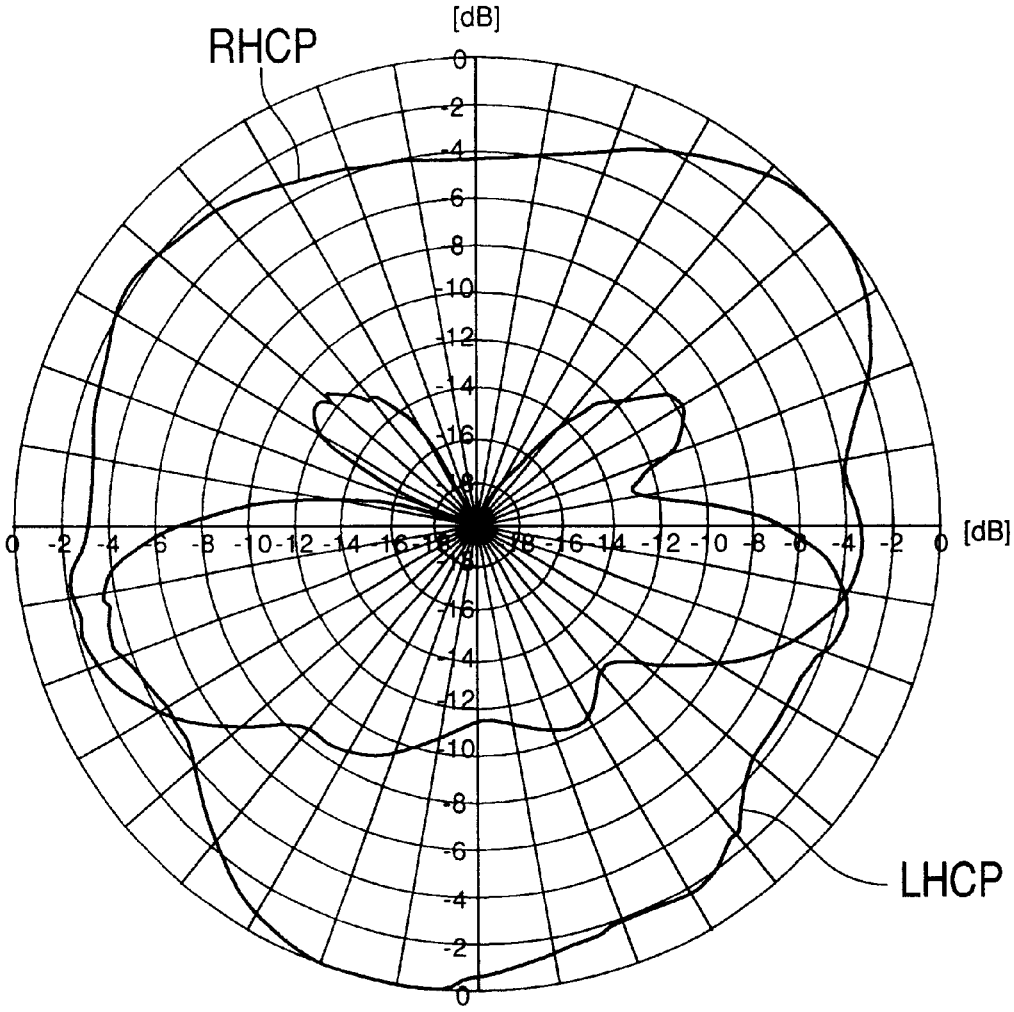
FIG. 8 is a diagram showing the result of measurement of a vertical-plane radiation pattern of the aforementioned antenna.

FIG. 8 shows a vertical-plane radiation pattern of the aforementioned circularly polarized antenna, in which RHCP (Right-Hand Circular Polarization) indicates the result of measurement of a radiation pattern of right-handed circularly polarized wave obtained when the antenna is set in a state where the right-handed circularly polarized wave is radiated upward (in the direction from the loop-shaped element toward the feeding points). Also, the aforementioned circularly polarized antenna, in which LHCP (Left-Hand Circular Polarization) indicates the result of measurement of a radiation pattern of left-handed circularly polarized wave obtained under the same conditions. Here, 0 dB reference level which corresponds to the circumference of the pie chart is −0.25 dBi and measurement frequency is 185 GHz.

Figure 1A:
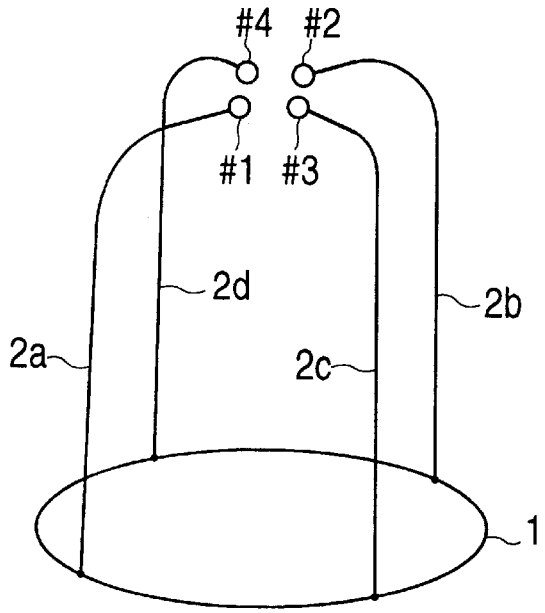
FIGS. 1A through 1C are diagrams showing an example of the structure of a circularly polarized antenna according to this invention.
Figure 1B:
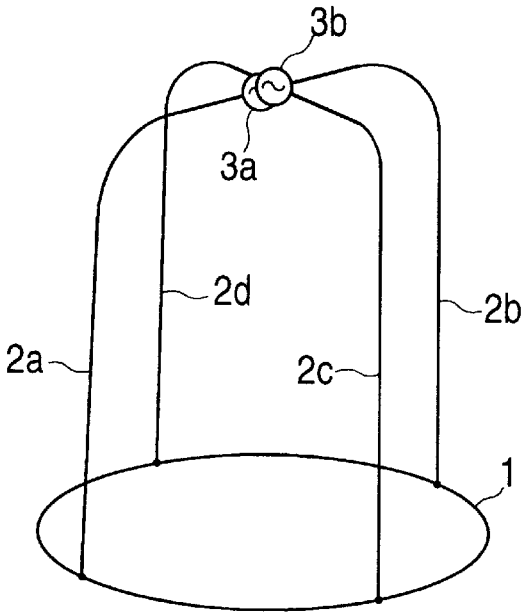
Figure 1C:
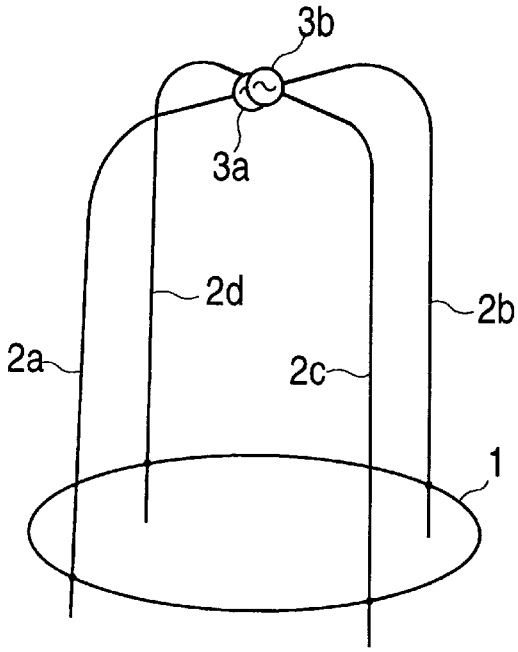
Figure 2A:
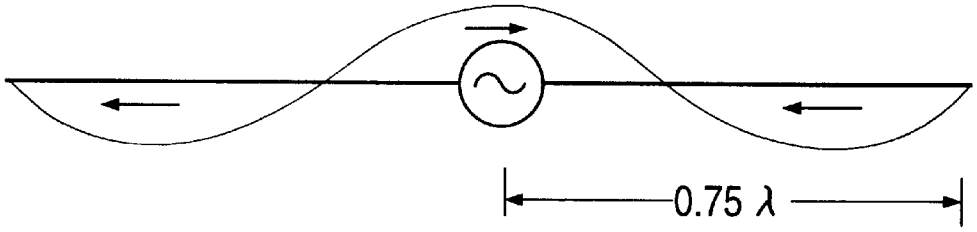
FIGS. 2A through 2C are diagrams illustrating the operational effects of the aforementioned antenna.
Figure 2B:
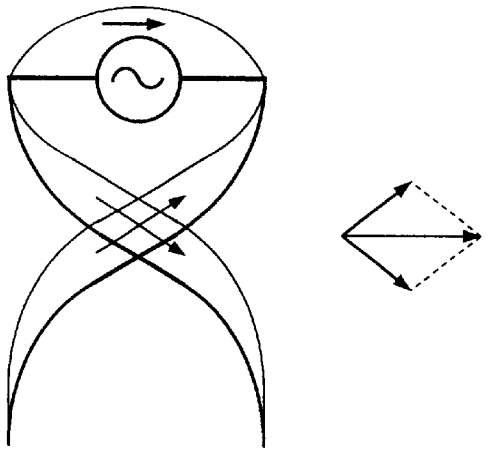
Figure 2C:
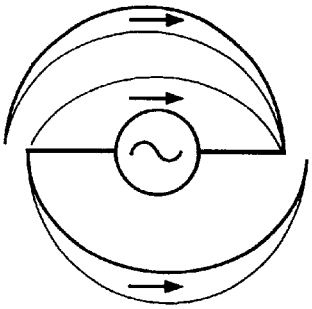
Figure 3A:
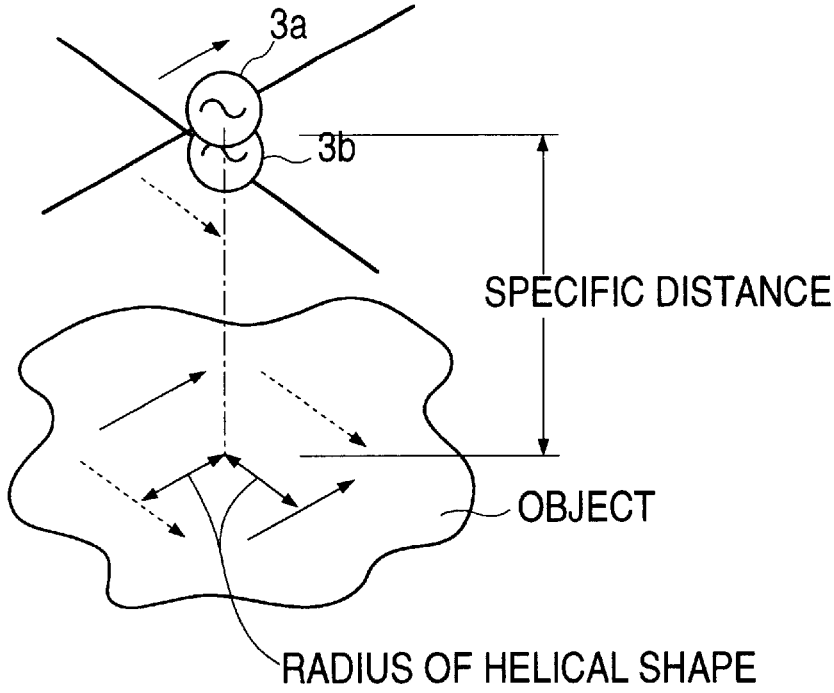
FIGS. 3A through 3B are diagrams illustrating the operational effects of the aforementioned antenna.
Figure 3B:
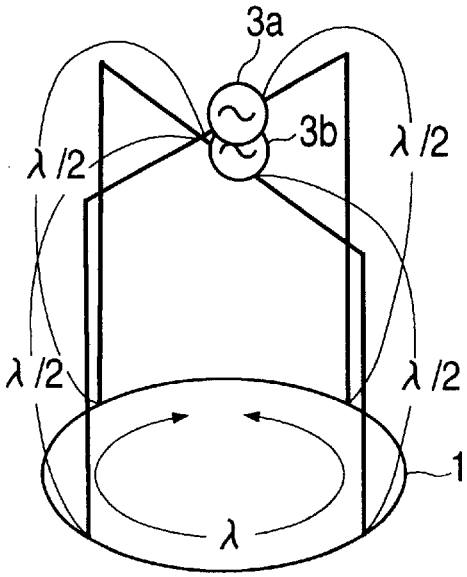
Figure 4:
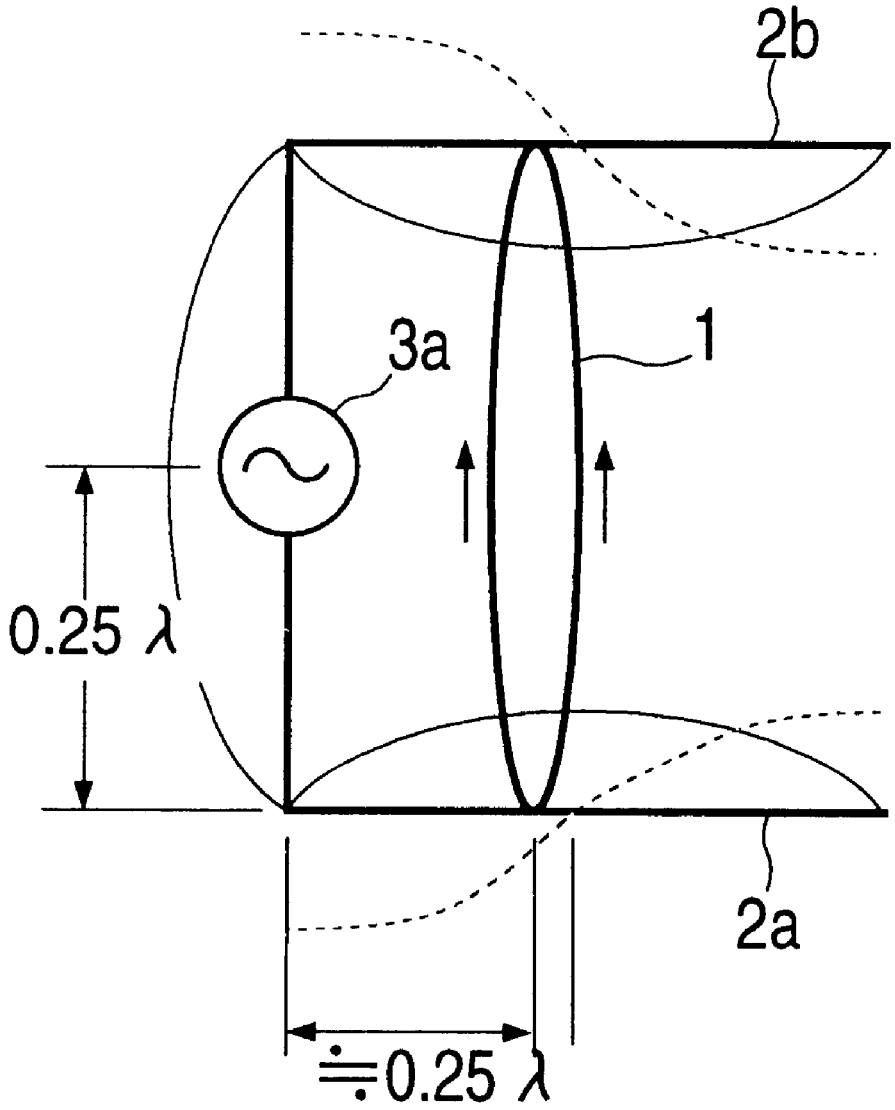
FIG. 4 is a diagram illustrating the operational effects of the aforementioned antenna.
Figure 5:
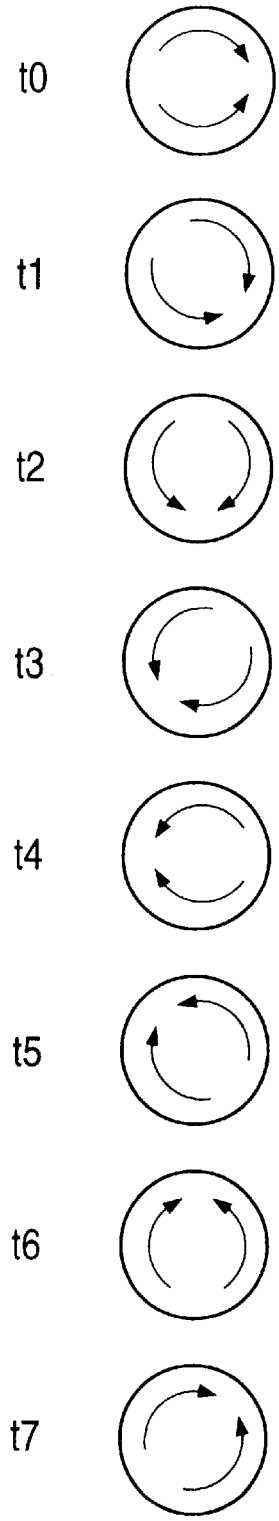
FIG. 5 is a diagram illustrating the operational effects of the aforementioned antenna.

By feeding the signals with a phase difference of 90° in a direction in which the right-handed circularly polarized wave is radiated, a high gain is obtained for an area upward from the horizontal plane over a wide angle, and the gain for an area beneath the horizontal plane decreases, so that the antenna exhibits a radiation pattern extending upward in generally a hemispherical form as a whole. On the contrary, the left-handed circularly polarized radio wave is radiated downward (in the direction from the feeding points toward the loop-shaped element). It can be seen from the chart that this downward-directed left-handed circularly polarized radio wave is radiated in a relatively narrower angular range compared to the angle of radiation of the upward-directed right-handed circularly polarized wave. These radiation patterns are equivalent to the characteristics of the earlier-mentioned four-wire fractional winding helical antenna and conical log spiral antenna. From this, it has been proved indirectly that the earlier assumption that electric current below the feeding points could be approximated by the vector sum of currents in the proximity of maximum current points in helically wound portions of the two elements, as explained with reference to FIGS. 2 and 3, was correct.

Figure 9:
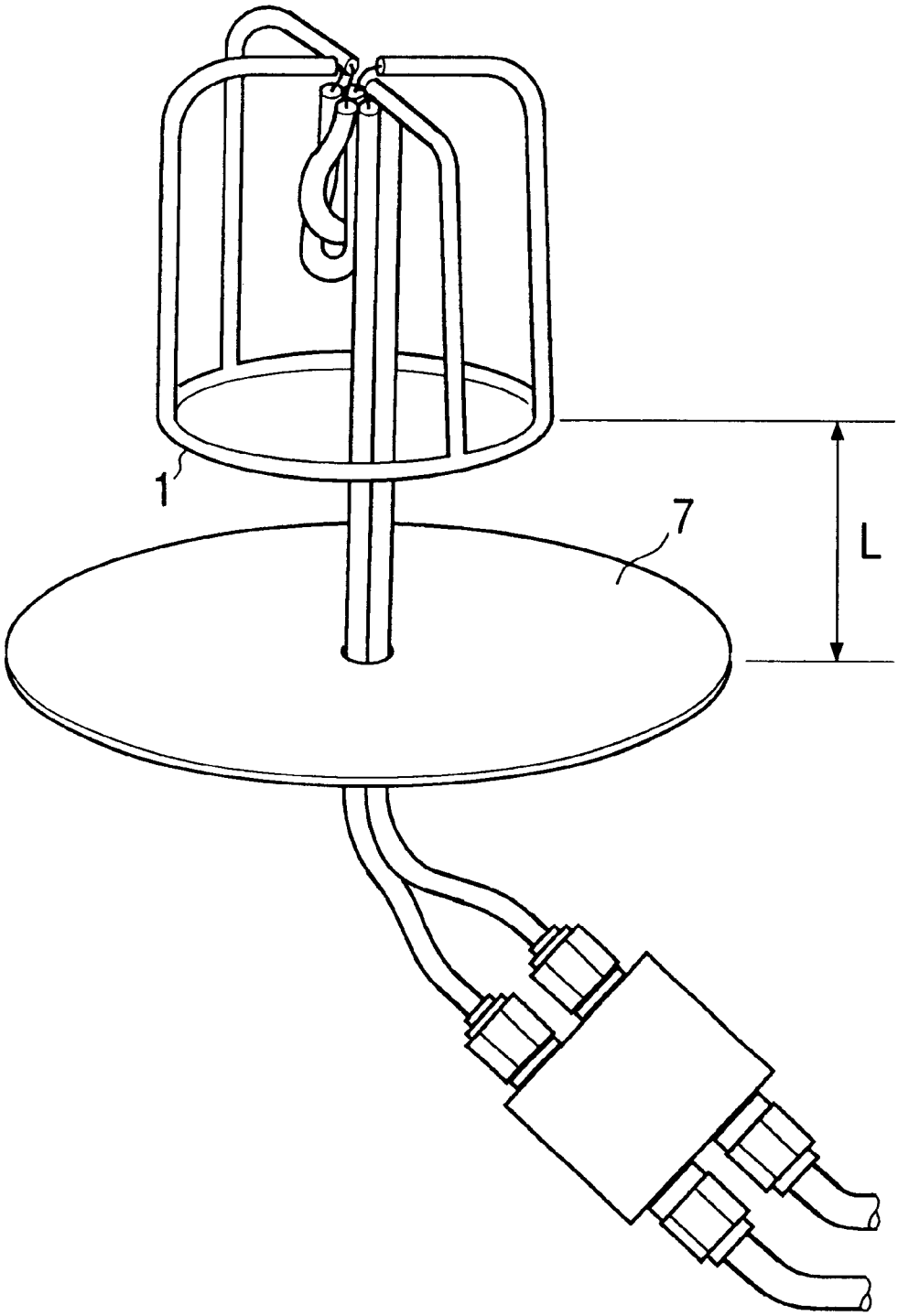
FIG. 9 is a diagram showing the structure of a circularly polarized antenna according to a second embodiment.

Next, the structure of a circularly polarized antenna according to a second embodiment is shown in FIG. 9. In this example, a reflector plate 7, which is parallel to a loop-shaped element 1, is provided at a position separated from the loop-shaped element 1 by a specific distance L.

As the reflector plate 7 is provided as stated above, the left-handed circularly polarized radio wave radiated downward as illustrated in FIG. 8 is reflected and radiated back upward as a right-handed circularly polarized wave. Consequently, the radiation pattern of the left-handed circularly polarized wave LHCP shown in FIG. 8 is folded back upward, whereby characteristics in which the radiation pattern of the left-handed circularly polarized wave LHCP is overlaid on the radiation pattern of the right-handed circularly polarized wave RHCP produced by the elements alone without the provision of the reflector plate 7 are obtained. As a result, it is possible to obtain a high gain while maintaining a wide-angle radiation pattern in the upward direction.

Since "fold-back" characteristics of the downward-directed radiation pattern produced by the reflector plate 7 vary according to the distance between the circularly polarized antenna and the reflector plate 7 and the shape of the reflector plate 7, it is possible to determine the upward-directed radiation pattern by properly setting the distance L between the loop-shaped element 1 and the reflector plate 7 and the shape of the reflector plate 7.

Figure 10A:
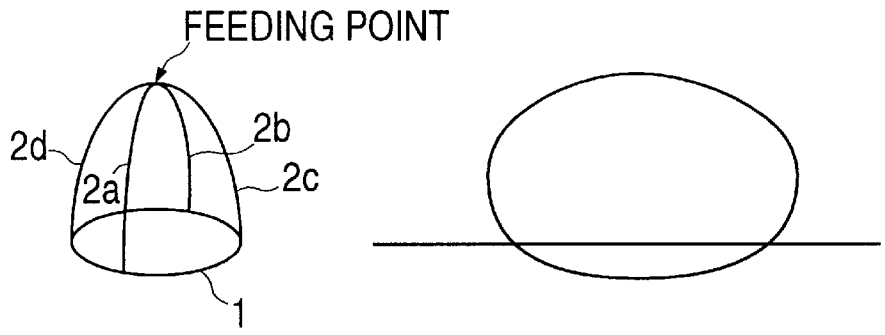
FIGS. 10A through 10C are diagrams showing variations of vertical-plane radiation patterns obtained when the shape of first to fourth elements is modified.
Figure 10B:
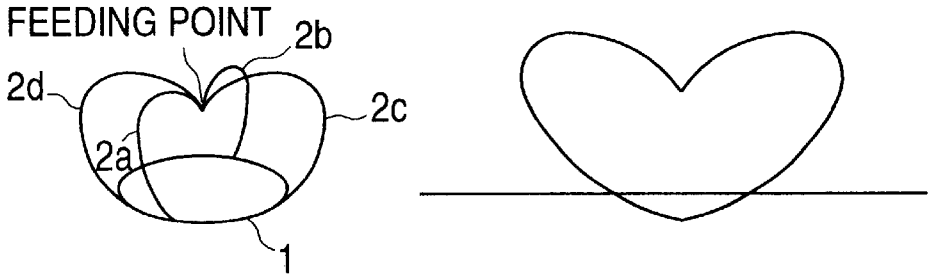
Figure 10C:
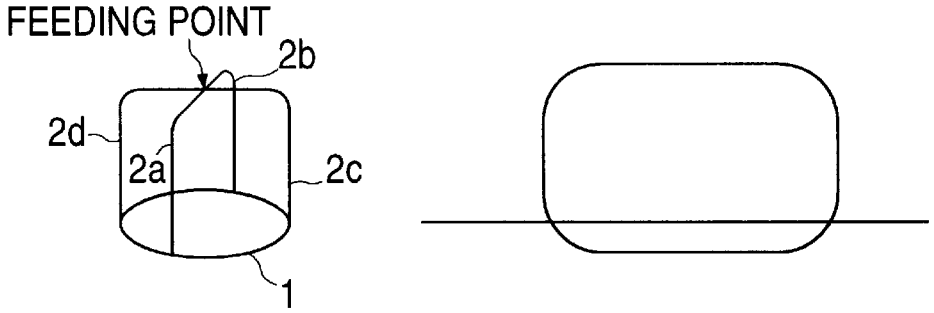

FIGS. 10A–10C show the structures of other circularly polarized antennas obtained by modifying the shape of the earlier-mentioned first to fourth elements as well as examples of measurement of approximate vertical-plane radiation patterns produced by those structures.

A circularly polarized antenna shown in FIG. 10A is an example in which the shape of first to fourth elements 2*a*–2*d* is gradually curved from their feeding points to four points on the loop-shaped element 1. According to this shape, the circularly polarized antennas exhibits generally a hemispherical wide-angle radiation pattern directed upward from the horizontal plane as shown at right in the Figure.

A circularly polarized antenna shown in FIG. 10B is an example in which the distance between feeding points and a loop-shaped element 1 is shortened and paths of elements 2*a*–2*d* from the feeding points to the loop-shaped element 1 are more sharply curved as a whole. According to this shape, gain increases in directions of a slightly lower elevation angle than in the direction of the zenith as shown at right in the Figure.

A circularly polarized antenna shown in FIG. 10C is an example in which portions of elements 2*a*–2*d* parallel to a loop-shaped element 1 and portions of the elements 2*a*–2*d* perpendicular to the loop-shaped element 1 are individually lengthened. According to this shape, the circularly polarized antennas exhibits a characteristic intermediate between FIGS. 10A and 10B.

Next, the structure of a circularly polarized antenna according to a third embodiment is described with reference to FIGS. 11 and 12.

Figure 11A:
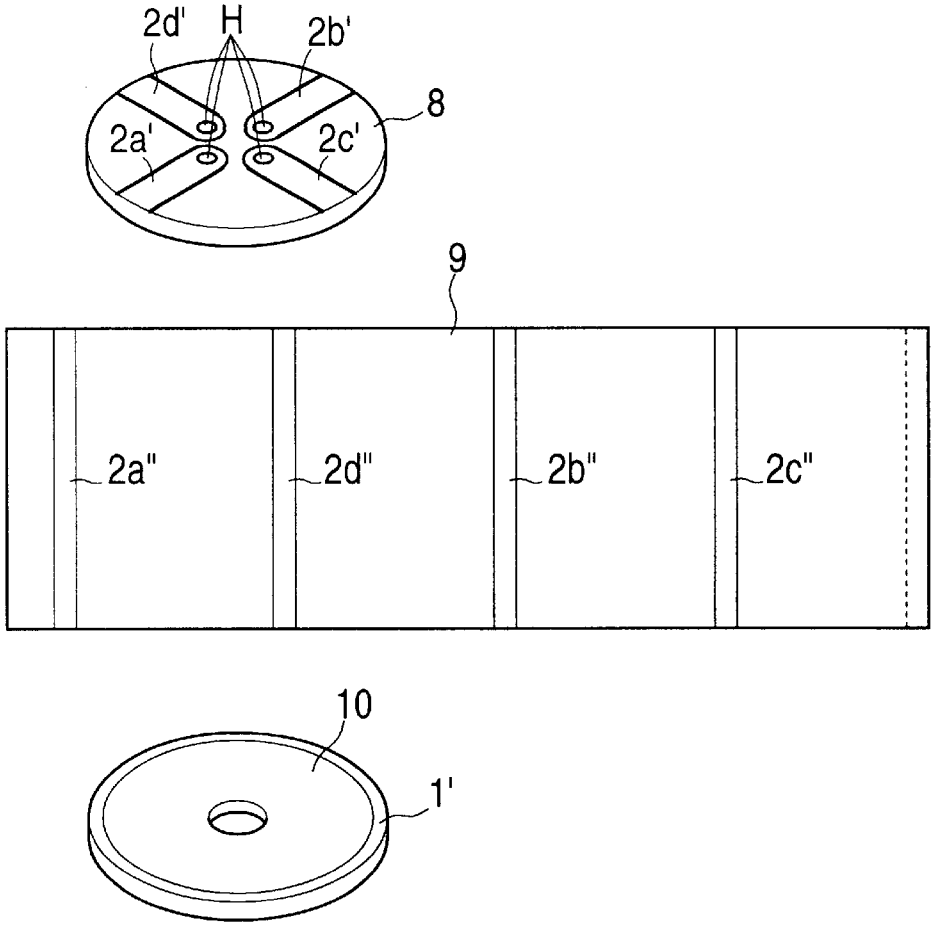
FIGS. 11A and 11B are exploded diagrams showing the structure of individual components of a circularly polarized antenna according to a third embodiment.

Although the loop-shaped element 1 and the first to fourth elements 2*a*–2*d* are constructed by bending line conductors in the foregoing embodiments, they are constructed by patterns on a substrate in this third embodiment. FIG. 11A is an exploded view of its principal components, in which designated by the numeral 8 is a first disk-shaped rigid substrate. There are formed four holes H in a central part of the first disk-shaped rigid substrate 8, and conductor patterns 2*a*'–2*d*' constituting parts of first to fourth elements are formed in radial directions from the four holes H. Designated by the numeral 9 is a flexible substrate, on which equally spaced linear conductor patterns 2*a*", 2*d*", 2*b*", 2*c*" also constituting parts of the first to fourth elements are formed. Designated by the numeral 10 is a second disk-shaped rigid substrate, around which a conductor pattern 1' serving as a loop-shaped element is formed.

The first to fourth elements and loop-shaped element are formed by assembling these substrates. Specifically, the flexible substrate 9 is wound around the circumferential surfaces of the substrates 8, 10 such that they together form a cylindrical shape, the substrate 10 forming a bottom surface, the substrate 8 forming a top surface and the flexible substrate 9 forming a side surface. In this assembly operation, terminal ends of the conductor patterns 2*a*", 2*d*", 2*b*", 2*c*" at one side are soldered to the conductor patterns 2*a*', 2*d*', 2*b*', 2*c*' on the substrate 8, respectively. Further, the opposite terminal ends of the conductor patterns 2*a*", 2*d*", 2*b*", 2*c*" are soldered to the loop-shaped conductor pattern 1' at its four equally dividing points from the inside of the flexible substrate 9 warped into a cylindrical shape. A starting part of winding of the flexible substrate 9 is then fixedly bonded to its ending part of winding. A unit constituting a principal part of the circularly polarized antenna is configured in this fashion.

Figure 11B:
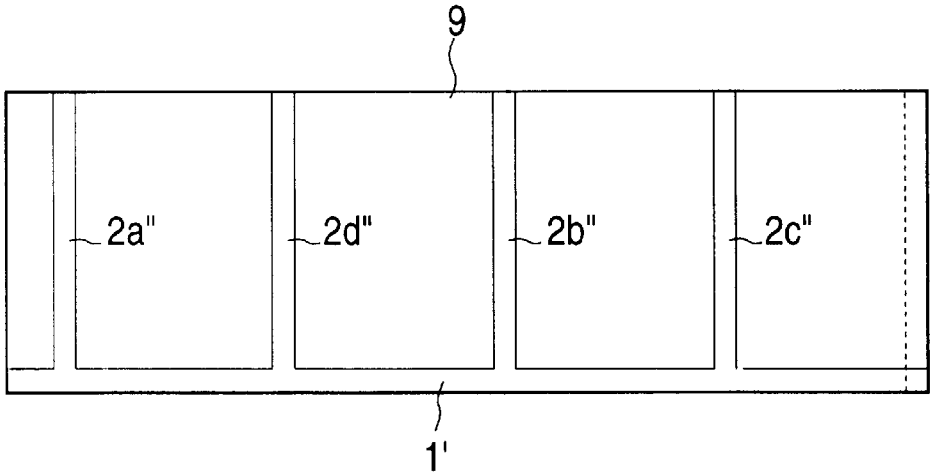

Although the conductor pattern 1' serving as the loop-shaped element is formed on the second substrate 10 in the example shown in FIG. 11A, the conductor pattern 1' serving as the loop-shaped element may be formed on the flexible substrate 9 with the second substrate 10 simply constituting an insulator board, as illustrated in FIG. 11B. In this case, the flexible substrate 9 may be fixedly bonded to the substrate 10.

Coaxial cables and baluns are inserted from the bottom of the substrate 8 and their center conductors are connected by soldering at a hole H in the substrate 8.

The conductor pattern serving as the loop-shaped element may be formed only on the flexible substrate 9 or on the second substrate 10.

Figure 12:
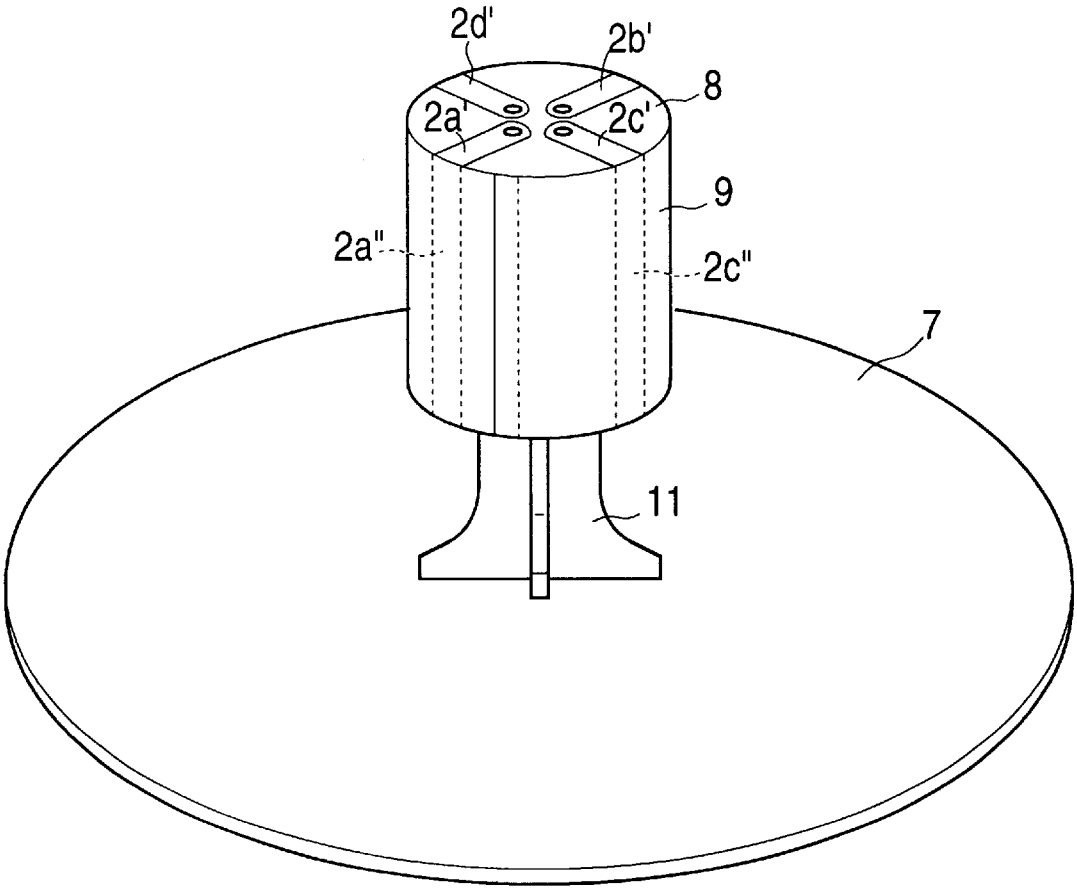
FIG. 12 is a perspective view of the whole of the aforementioned antenna.

FIG. 12 is a perspective view showing a state where the above-described circularly polarized antenna is mounted on a reflector plate, in which designated by the numeral 11 is a support base for supporting the unit formed of the aforementioned substrates 8, 10 and flexible substrate 9 and for separating the unit from the reflector plate 7. It is possible to easily configure the individual elements and maintain their positional relationship by the above-described structure.

Instead of using coaxial cables to constitute baluns for performing mode conversion between the balanced transmission mode and the unbalanced transmission mode, the baluns may be configured by conductor patterns formed on the aforementioned substrate 8. This will help simplify manufacture of the baluns and decrease variations in their characteristics.

Next, the structure of a circularly polarized antenna according to a fourth embodiment is described with reference to FIGS. 13 to 15. This embodiment is characterized in that the entirety of first to fourth elements is formed on rigid substrates and a loop-shaped element is formed of a beltlike conductor.

Figure 13:
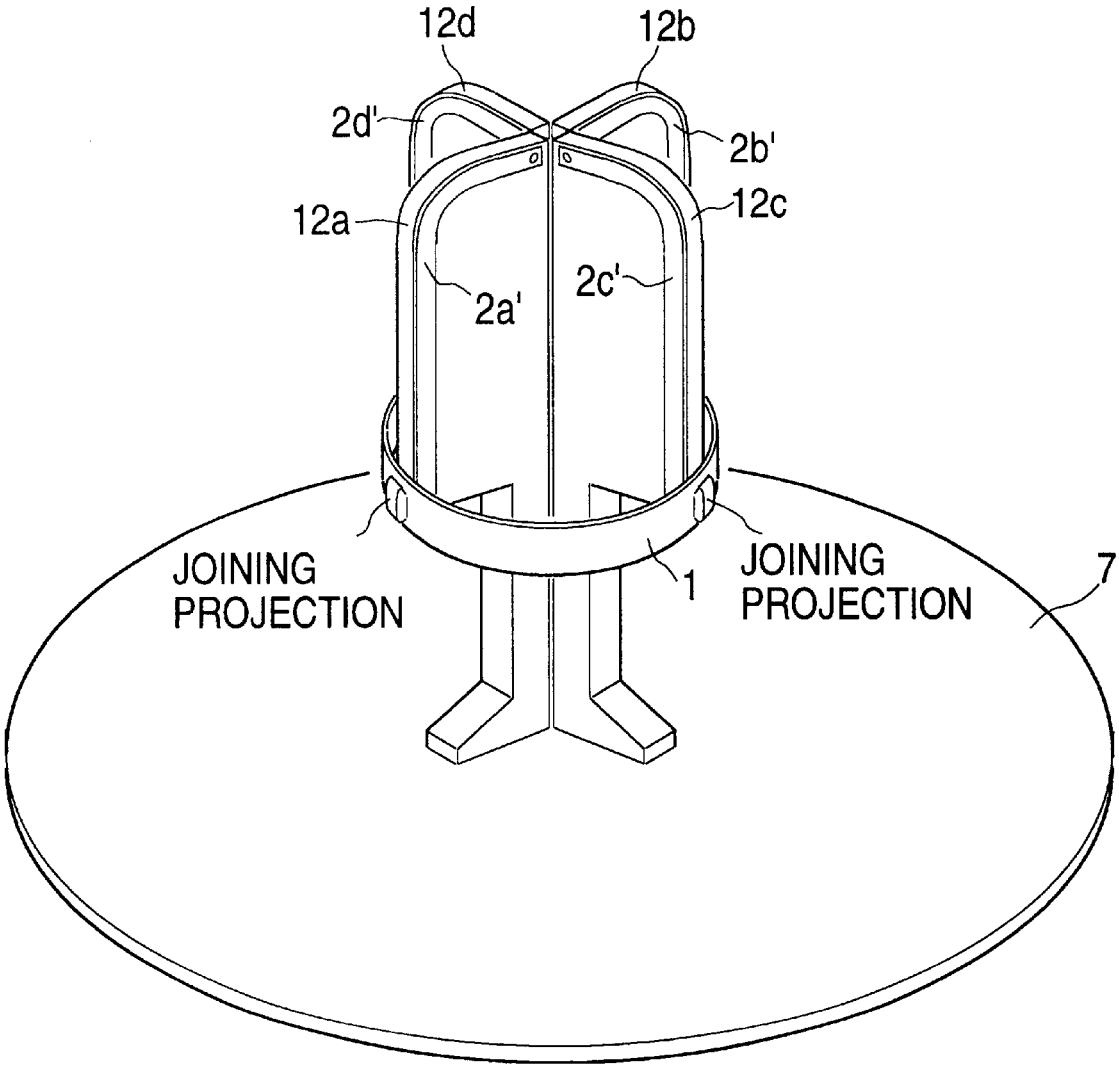
FIG. 13 is a perspective view showing the structure of a circularly polarized antenna according to a fourth embodiment.

FIG. 13 is a perspective view showing the structure of the whole of the circularly polarized antenna, in which designated by the numerals 12*a*, 12*b*, 12*c*, 12*d* are rigid substrates, and conductor patterns 2*a*'–2*d*' corresponding to the first to fourth elements are formed on both sides of the individual substrates 12*a*–12*d*, respectively. Designated by the numeral 1 is the loop-shaped element formed of the beltlike conductor, which is soldered to the conductor patterns 2*a*'–2*d*' at positions where the loop-shaped element 1 is in contact with end surfaces of the substrates 12*a*–12*d*. A unit thus constructed is attached to a central part of a reflector plate 7.

While the conductor patterns are formed on both sides of the individual substrates 12*a*–12*d* in this example, four substrates carrying conductor patterns formed on only one side of each substrate may be used with these substrates arranged at 90° angular intervals.

Figure 14A:
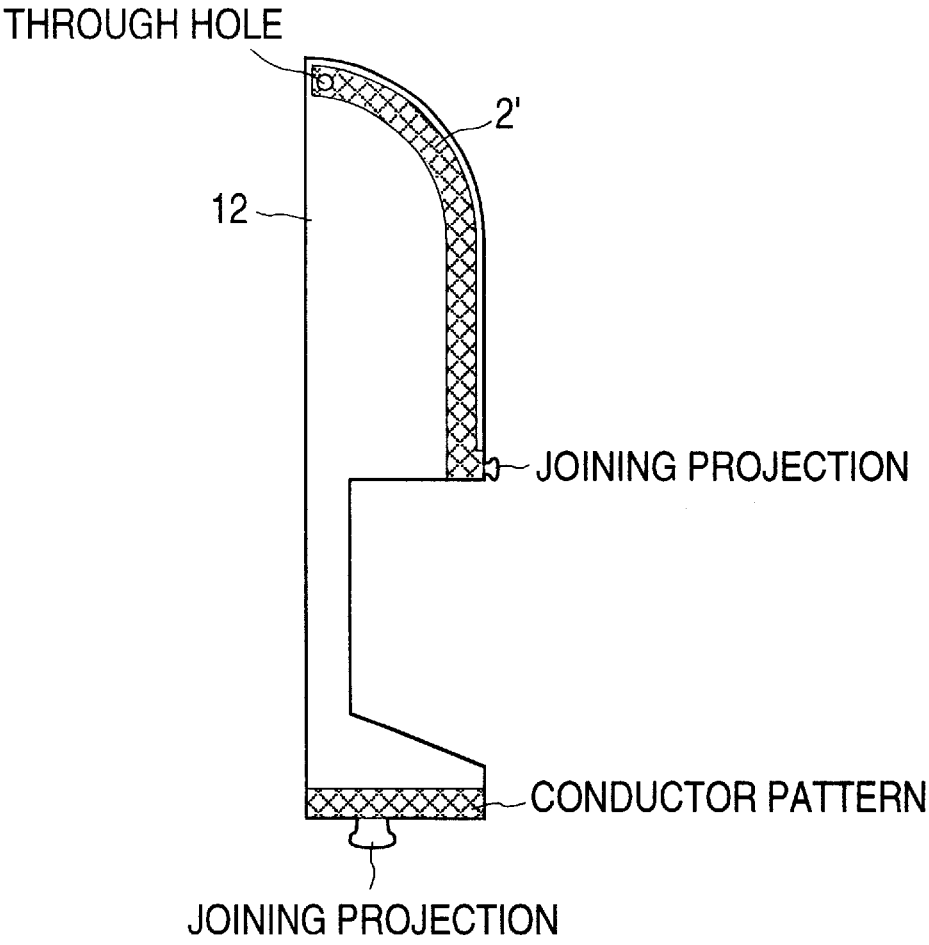
FIGS. 14A and 14B are developments showing the structure of individual components the aforementioned antenna.
Figure 14B:
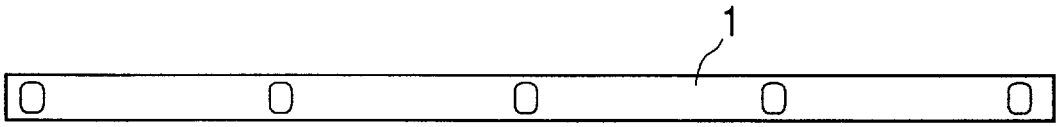

FIG. 14A is a plan view of the substrate representing one of the aforementioned four substrates, and FIG. 14B is a development of the aforementioned loop-shaped element 1. Conductor patterns 2' are formed on both sides of a substrate 12, there is formed a plated through hole at an upper end of each conductor pattern 2' for electrically connecting the conductor patterns on both sides. There are formed joining projections at a bottommost part of the conductor patterns 2' on the substrate 12 and on a bottom surface of the substrate 12. Further, conductor patterns are formed at a bottom part of the substrate 12. On the other hand, there are formed five holes in the loop-shaped element 1 for fitting the joining projections provided at the bottommost part of the aforementioned conductor patterns 2'.

In the reflector plate 7 shown in FIG. 13, there are formed four holes in which the joining projections provided on the bottom surfaces of the individual substrates are fitted. The four substrates 12 are mounted on the reflector plate 7 by fitting the joining projections provided on the bottom surfaces of the four substrates 12*a*–12*d* in such a manner that the four substrates form a vertically standing crossing structure as a whole. In this assembly operation, the conductor patterns at the bottom part of the substrates are fixed to the reflector plate 7 by soldering. Then, by fitting the joining projections provided at the bottommost parts of the conductor patterns 2' on the substrates into the holes formed in the loop-shaped element 1 and soldering them, these joining projections are fixed to the loop-shaped element 1. Of the five holes in the loop-shaped element 1, two situated at extreme ends of the loop-shaped element are fitted on the same joining projection and soldered thereto to form a loop structure. With the loop-shaped element 1 soldered in this manner, both sides of each of the conductor patterns 2*a*'–2*d*' are electrically connected to each other at their bottommost parts. In one alternative, the loop-shaped element 1 may be formed of a line conductor instead of the beltlike conductor.

Figure 15:
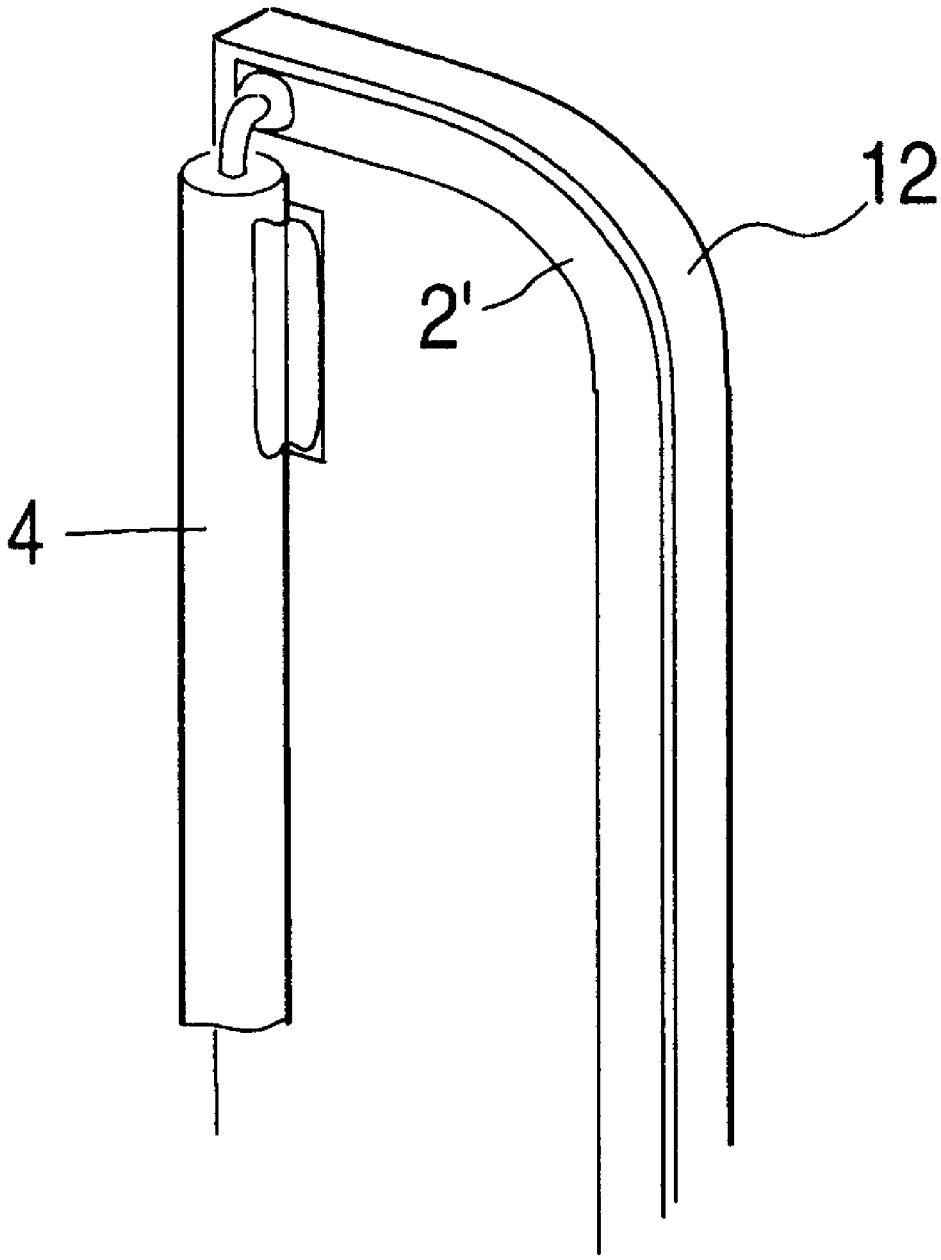
FIG. 15 is a perspective view showing a structure for connecting a coaxial cable to a substrate of the aforementioned antenna.

FIG. 15 shows a structure for connecting a coaxial cable 4 to the conductor patterns corresponding to the aforementioned first to fourth elements. In FIG. 15, indicated by the numeral 2' is a conductor pattern which corresponds to one of the first to fourth elements. A center conductor of the coaxial cable 4 which serves as a balun or a feeder cable is soldered to the plated through hole formed at the upper end of the conductor pattern 2'. The coaxial cable 4 is fixed by bonding itself to the surface of the substrate 12, or the outer conductor of the coaxial cable 4 is soldered to a mounting conductor pattern of the coaxial cable 4. The coaxial cable 4 used as a balun or a feeder cable is mounted at around the upper end of the substrate 12 as stated above. Instead of forming the plated through hole for inserting the center conductor of the coaxial cable 4, the center conductor of the coaxial cable 4 may be passed through a mere hole provided on the substrate 12, and soldered on both sides of the substrate 12 to thereby connect the conductor patterns on both sides of the substrate 12 electrically.

Although the conductor patterns on both sides of each substrate are connected to each other at their upper ends and lower ends in the example shown in FIGS. 13 to 15, there may be provided a plurality of plated through holes in the conductor patterns.

Although coaxial cables are used to constitute baluns for performing mode conversion between the balanced transmission mode and the unbalanced transmission mode in the foregoing examples, means for mode conversion may be formed on the aforementioned reflector plate 7. Specifically, the circularly polarized antenna may be constructed such that the aforementioned reflector plate 7 is a double-sided substrate with its element side forming generally a full-surface conductor pattern held at ground potential and its opposite side carrying a conductor pattern which serves as baluns, and this conductor pattern forming the baluns and the elements on the substrates 12 are connected by feeder lines set to the balanced transmission mode.

With this arrangement, it becomes possible to easily configure the baluns in a broad area separated from the first to fourth elements and to easily feed electric power to the feeding points of the first and second feeding points in the balanced transmission mode.

Next, the structure of a circularly polarized antenna according to a fifth embodiment is described with reference to FIGS. 16 and 17. This embodiment is characterized in that first to fourth elements are formed on two substrates and a loop-shaped element is formed of a beltlike conductor.

Figure 16:
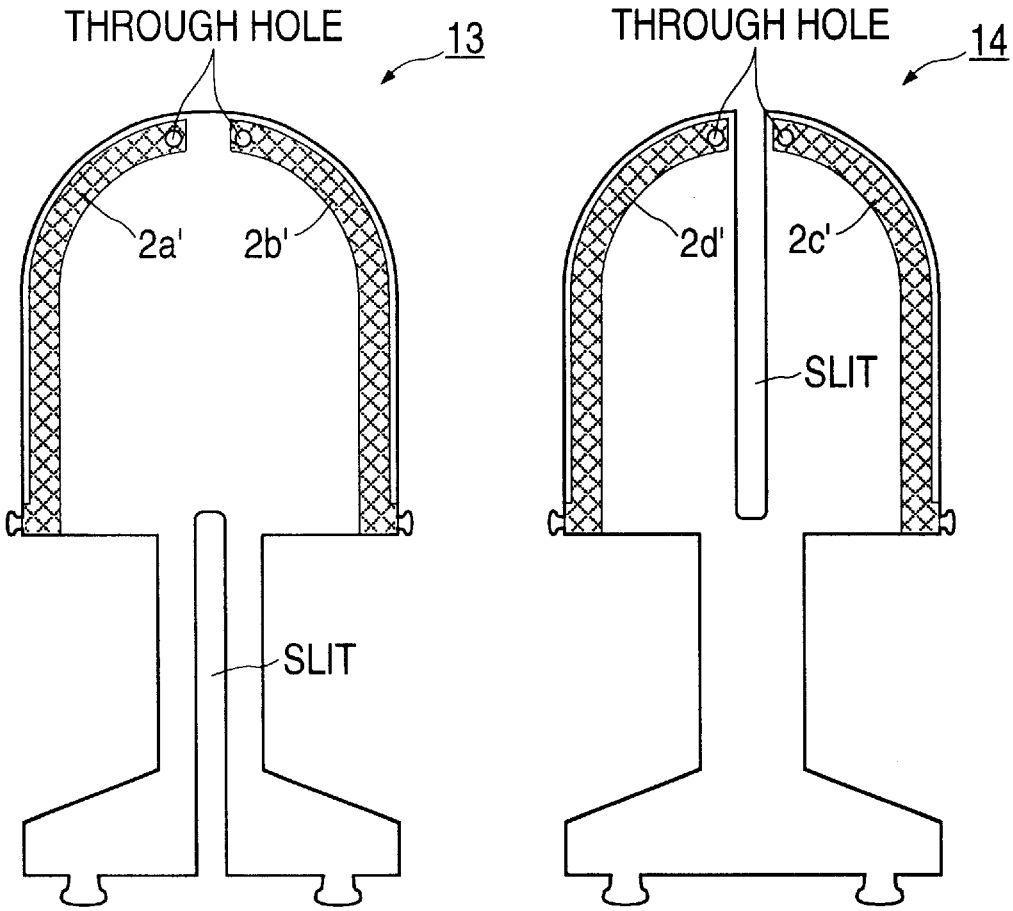
FIG. 16 is a diagram showing the structure of substrates of a circularly polarized antenna according to a fifth embodiment.

FIG. 16 is a plan view of the two substrates 13, 14. Conductor patterns 2*a*', 2*b*' are formed on one substrate 13 and a slit is formed in a lower portion of the substrate 13. Conductor patterns 2*c*', 2*d*' are formed on the other substrate 14 and a slit is formed in an upper portion of the substrate 14. Further, joining projections for fitting the substrates to a reflector plate are formed at bottommost parts of the individual substrates.

Figure 17:
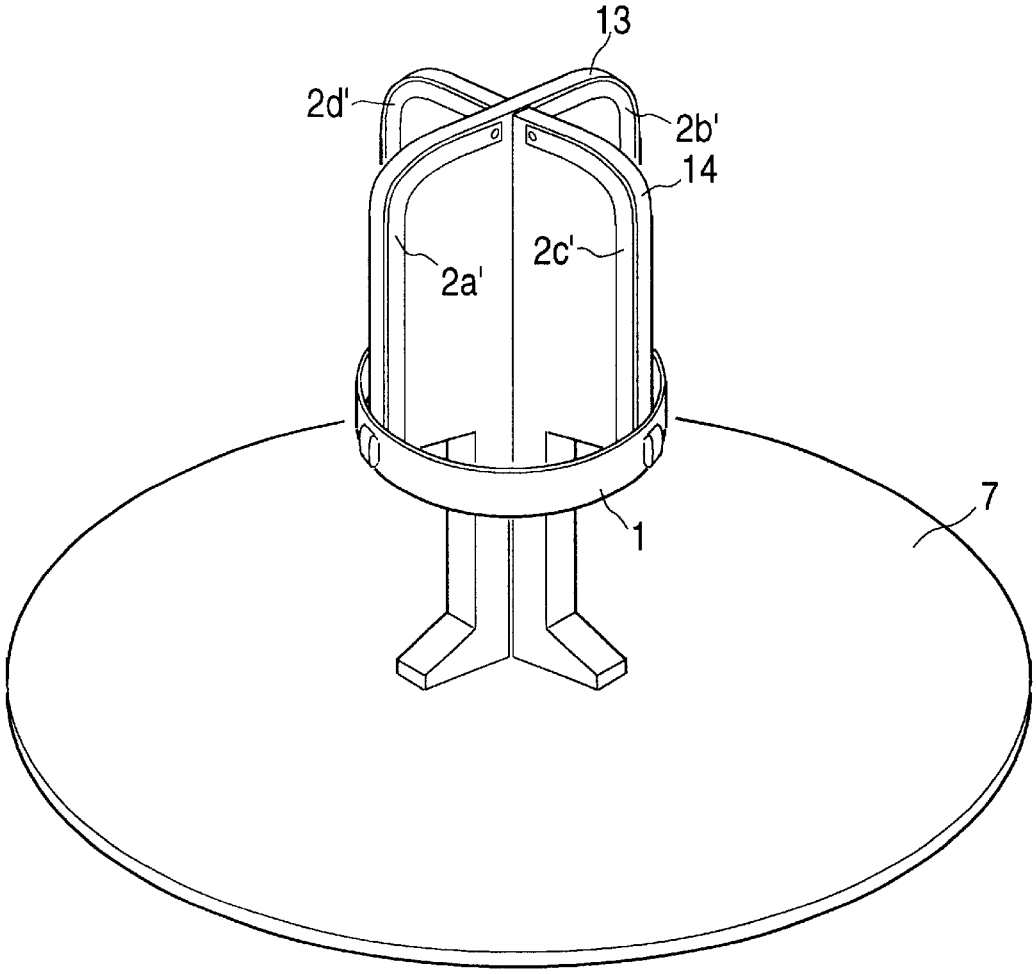
FIG. 17 is a perspective view showing the structure of the aforementioned circularly polarized antenna.

FIG. 17 is a perspective view showing the overall structure of the circularly polarized antenna. The two substrates 13, 14 shown in FIG. 16 are attached to the reflector plate 7 with their slits fitted into each other. The construction is otherwise same as the fourth embodiment.

Although the conductor patterns are provided on both sides of the substrates 13, 14 in this example again, the conductor patterns 2*a*'–2*d*' may be formed on one side of each substrate.

Figure 18A:
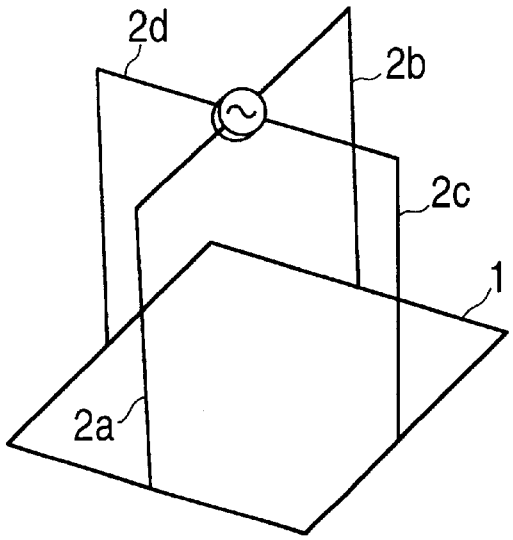
FIGS. 18A and 18B are diagrams showing the structure of a circularly polarized antenna according to a sixth embodiment.
Figure 18B:
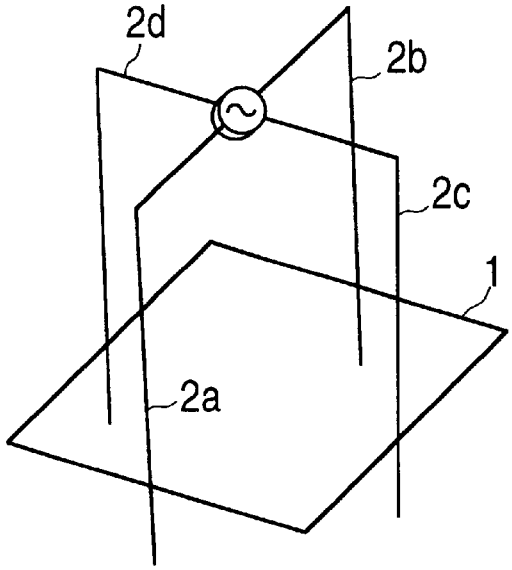

FIGS. 18A and 18B are perspective views showing the structure of a circularly polarized antenna according to a sixth embodiment. While one end of each of first to fourth elements is used as a feeding point and the other ends are connected to the loop-shaped element in the aforementioned embodiments, a loop-shaped element is connected to first to fourth elements at points close to ends the first to fourth elements in this sixth embodiment. Also, the loop-shaped element 1 is made to have a square shape, instead of a circular shape, in this example.

Shown in FIG. 18A is a comparative example, in which the frequency is set to 20 MHz (wavelength≈15 m), one side of the loop-shaped element 1 is 3.885 m long, the length of vertical portions of the first to fourth elements 2*a*–2*d* is 5.22 m (the length from the feeding point to each connecting point of the loop-shaped element 1 is 5.11+(3.885/2)=7.163 m). When each element is formed of a cylinder whose diameter is 20 cm, the characteristic impedance becomes 181 ohms (imaginary component being 0) in this structure.

In the structure shown in FIG. 18B, on the other hand, one end of each of the first to fourth elements 2*a*–2*d* is used as a feeding point and the elements 2*a*–2*d* are connected to the loop-shaped element 1 at the points 0.47 m above the other ends. Specifically, the first to fourth elements 2*a*–2*d* each have a downward projecting part which is 0.47 m long. In addition, the length of each side of the loop-shaped element 1 is made equal to 3.885 m and the length of vertical portions of the first to fourth elements 2*a*–2*d* is made equal to 5.233 m. When each element is formed of a cylinder whose diameter is 20 cm, the characteristic impedance becomes 199.5 ohms (imaginary component being 0) in this structure.

By changing the length of the projecting parts of the first to fourth elements 2*a*–2*d* from the loop-shaped element 1 in this way, it is possible to vary the real part of the impedance when the imaginary part of the characteristic impedance is brought close to 0.

Although an ideal solution when using 50-ohm coaxial cables as feeder lines and 4:1 baluns at the feeding points is that the antenna impedance is 200 ohms containing only a real component (=resistance only) as stated earlier, it is possible to bring the antenna impedance close to an ideal value by adjusting the length of the aforementioned projecting parts. It is to be noted, however, that the longer the projecting parts are made, the more the efficiency of the entire antenna decreases, because currents flow in opposite directions in the projecting parts located opposite each other. Therefore, the antenna should be designed in consideration of the importance of the antenna efficiency and impedance matching.

The perimeter of the loop-shaped element 1 need not necessarily be exactly equal to the wavelength electrically, but a slight variation in length is permissible.

When the loop-shaped element 1 is made shorter, for example, it is possible to bring the imaginary part of the characteristic impedance close to 0 by increasing the length of the elements 2*a*–2*d*. In this case, the real component of the characteristic impedance becomes smaller and the elevation angle of a main lobe decreases in terms of directivity.

When the loop-shaped element 1 is made longer, on the contrary, it is possible to bring the imaginary part of the characteristic impedance close to 0 by decreasing the length of the elements 2*a*–2*d*. In this case, the real component of the characteristic impedance becomes larger and the elevation angle of a main lobe increases in terms of directivity.

Since the efficiency of the circularly polarized antenna is the highest when the perimeter of the loop-shaped element 1 is electrically close to the wavelength, the length of the individual elements is to be determined in consideration of the importance of the antenna efficiency, impedance matching and directivity.

Next, the structure of a circularly polarized antenna according to a seventh embodiment is described with reference to FIGS. 19 and 20.

Figure 19:
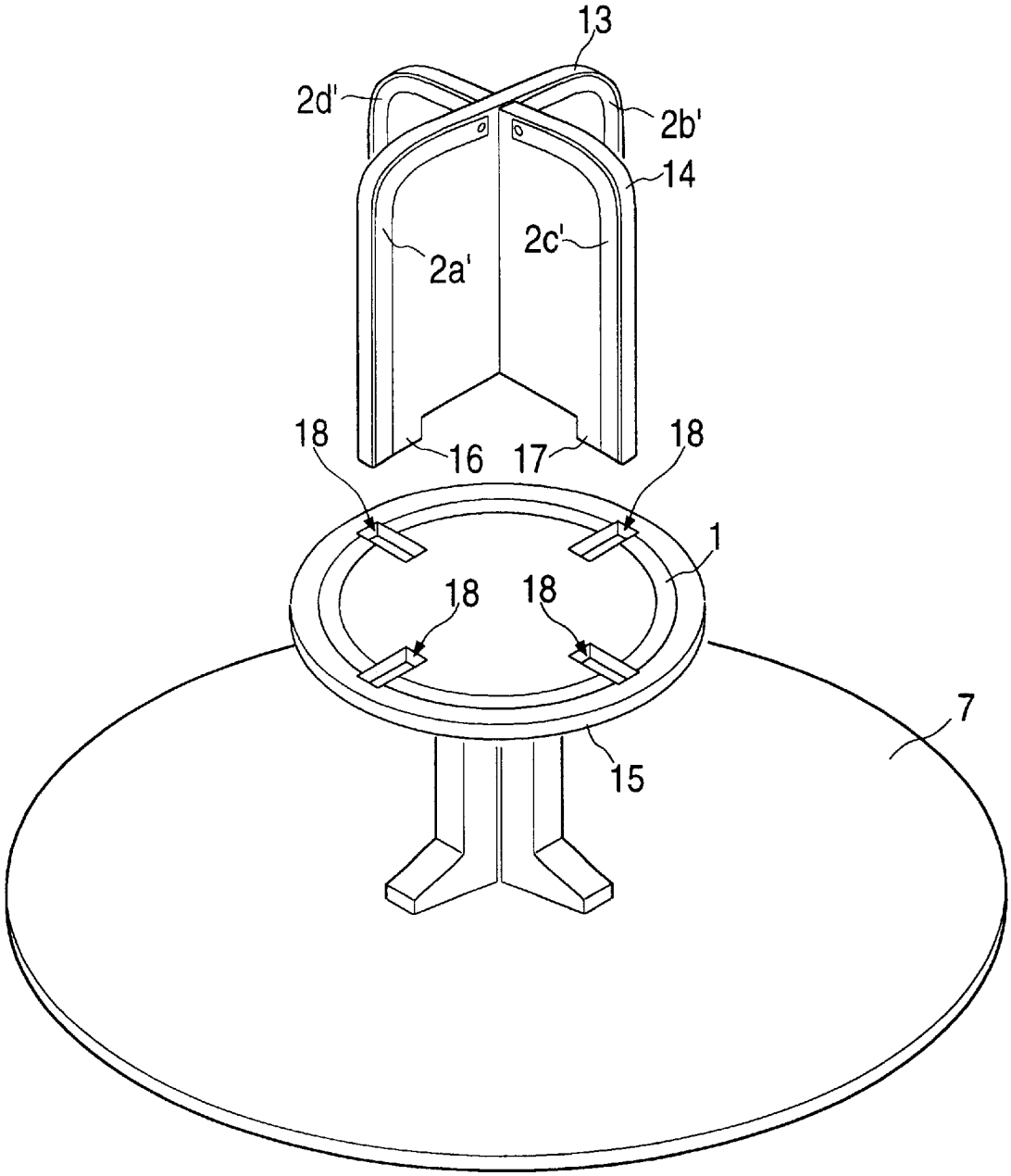
FIG. 19 is an exploded perspective view showing the structure of a circularly polarized antenna according to a seventh embodiment.
Figure 20:
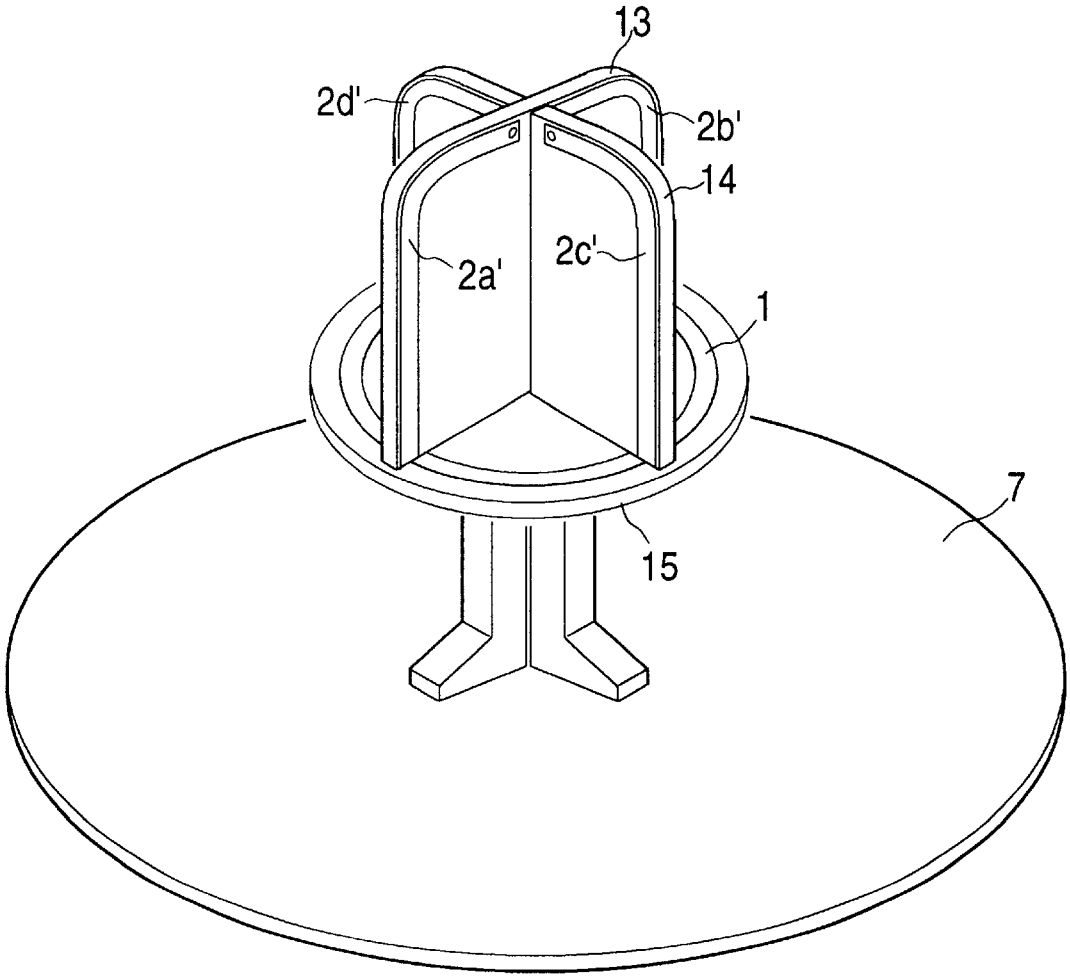
FIG. 20 is a perspective view showing the state of the aforementioned antenna after its assembly.
Figure 21:
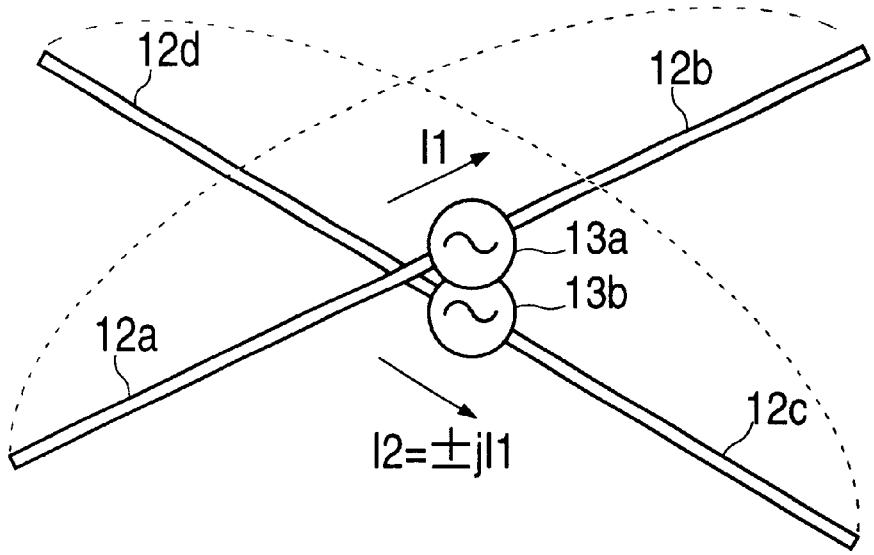
FIG. 21 is a diagram showing the structure of a conventional cross dipole antenna.
Figure 22:
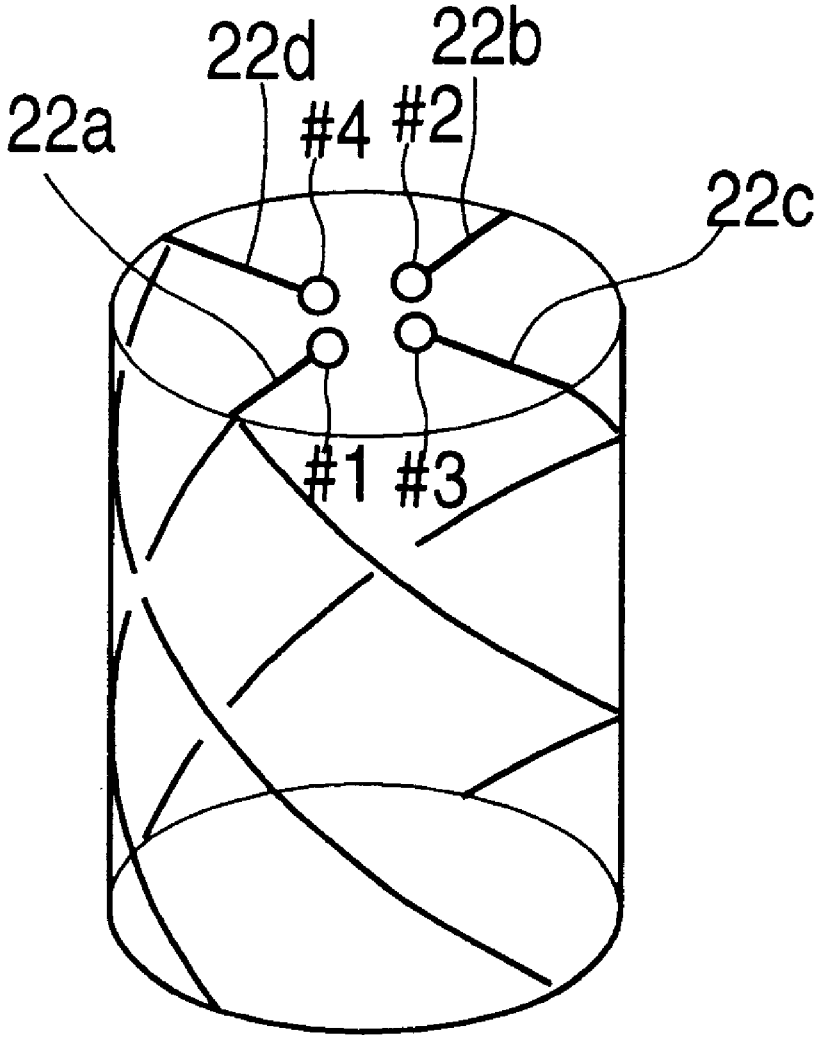
FIG. 22 is a diagram showing the structure of a conventional four-wire fractional winding helical antenna.

FIG. 19 is an exploded perspective view and FIG. 20 is a perspective view showing the state of the antenna after its assembly. This embodiment is characterized in that a loop-shaped element itself is formed on a rigid substrate.

Referring to FIG. 19, designated by the numerals 13 and 14 are rigid substrates carrying conductor pattern 2*a*'–2*d*' corresponding to first to fourth elements formed on both sides. These two substrates 13, 14 have a structure identical to the shape shown in FIG. 16 except that its supporting base portion is removed and projecting parts 16, 17 are formed. Designated by the numeral 15 is also a rigid substrate, in which four holes 18 for inserting the projecting parts 16, 17 of the substrates 13, 14 are formed. A loop-shaped element 1 made of a conductor pattern which sequentially join the four holes 18 is formed on a top surface of the substrate 15. This substrate 15 is supported by a support base in a position parallel to a reflector plate 7 and separated therefrom by a specific distance as illustrated.

From the state shown in FIG. 19, the projecting parts 16, 17 of the substrates 13, 14 are inserted into the holes 18 in the substrate 15 and bottom ends of the first to fourth elements or the proximity of the bottom ends are connected to the conductor pattern of the loop-shaped element by soldering to thereby construct the circularly polarized antenna shown in FIG. 20.

While the loop-shaped elements shown in the foregoing embodiments have a circular or square shape, the shape of the loop-shaped element may be any polygon including a triangle and those having more sides than the triangle, or a combination of parts of those polygons.

It is also possible to shorten or extend the length of actual elements in relation to a specific electrical length by providing extension coils or shortening capacitors at specific positions of the loop-shaped element or the first to fourth elements, or by providing a combination of the extension coils and shortening capacitors.

The reflector plate may have other shapes than the circular one, such as a polygon or a combination of polygons. Furthermore, a case of a transceiver amplifier or of a 3 dB directional coupler or part of the case may be used as a reflector plate.

Furthermore, the reflector plate is not limited to a flat shape. It is also possible to shape the reflector plate to form a concave surface or a convex surface or to form it into a conical or pyramid shape.

While the foregoing discussion of the first embodiment has revealed the examples in which equal electric power is fed into two feeding points with a phase difference of 90°, if the phase difference between the signals fed into the two feeding points of the antennas shown in this first and the other individual embodiments, and the ratio of input electric power of the signals are varied, each of the antennas of the embodiments works as an antenna for radio waves having a desired rotating direction and axial ratio (elliptically polarized waves). Therefore, it is possible to use the antennas shown in the embodiments as antennas for measuring equipment. It is also possible to adapt the antennas to radio waves whose axial ratio has changed due to ionized layers.

According to the present invention, it becomes possible to electrically adapt the antenna to both the right-handed circularly polarized wave and the left-handed circularly polarized wave without altering the shape of the antenna and to transmit and receive circularly polarized waves having different rotating directions at nearby frequencies or at the same frequency with the single antenna.

Furthermore, since the antenna of the invention can simultaneously receive a circularly polarized wave having a specific rotating direction and another circularly polarized wave having an opposite rotating direction, it becomes possible to sample components of almost purest direct wave and of almost purest reflected wave by deriving the differential between the circularly polarized waves of the opposite rotating directions.

Furthermore, the physical size of element portion is reduced to about two thirds compared to the four-wire fractional winding helical antenna.

Furthermore, since the wave having the opposite rotating direction radiated in a direction from the feeding points toward the loop-shaped element is reflected back by the reflector plate as a circularly polarized wave having the specific rotating direction, it is possible to eliminate directivity in undesired directions and to increase gain in a specific direction.

Furthermore, since the antenna impedance is 200 ohms, it is possible to easily feed electric power and achieve impedance matching by using 4:1 baluns and 50-ohm coaxial cables as feeder lines.

Furthermore, it is possible to easily configure the baluns in a broad area separated from the first to fourth elements and feed electric power to the first and second feeding points in the balanced transmission mode.

Furthermore, since the whole or part of each element is formed on a substrate, it becomes easier to form the individual elements and the structure for keeping them in specific shapes also becomes simple.

Furthermore, it becomes easier to manufacture the baluns and variations in their characteristics become smaller.

Moreover, it becomes easier to configure the first to fourth elements and to retain them in specific shapes.

In addition, it becomes easier to form the loop-shaped element and the structure for keeping it in a specific shape also becomes simple.

INDUSTRIAL APPLICABILITY

The present invention has applicability to circularly polarized antennas utilized in satellite communications systems.

What is claimed is:

1. A circularly polarized antenna comprising:

a loop-shaped element whose perimeter is approximately equal to the wavelength of radiated radio wave; and four elements extending upward from the loop-shaped element whose terminal ends or points near the terminal ends at one side are connected to the loop-shaped element at its four equally dividing points, feeding points being provided at the opposite terminal ends of said four elements, and the length of each of said four elements being approximately equal to half the wavelength of the radiated radio wave.

2. The circularly polarized antenna according to claim 1 further comprising a reflector plate provided at a position separated from said loop-shaped element by a specific distance, said reflector plate being disposed parallel to said loop-shaped element.

3. The circularly polarized antenna according to claim 1 further comprising baluns connected to said feeding points for performing mode conversion between unbalanced transmission mode and balanced transmission mode.

4. The circularly polarized antenna according to claim 1 further comprising:

a first substrate on which a conductor pattern constituting parts of said four elements is formed;

a second substrate disposed parallel to said first substrate with a conductor pattern constituting said loop-shaped element formed on the second substrate near its outer periphery; and a cylindrical substrate joining said first and second substrates to each other with a conductor pattern constituting the remaining parts of said four elements formed on the cylindrical substrate.

5. The circularly polarized antenna according to claim 4, wherein baluns are provided on said first substrate.

6. The circularly polarized antenna according to claim 1 further comprising:

a first substrate on which a conductor pattern constituting parts of said four elements is formed;

a second substrate disposed parallel to said first substrate;

a cylindrical substrate joining said first and second substrates to each other with a conductor pattern constituting the remaining parts of said four elements and said loop-shaped element formed on the cylindrical substrate.

7. The circularly polarized antenna according to claim 1, wherein said feeding points and said four elements are individually formed on a substrate.

8. The circularly polarized antenna according to claim 7, wherein said substrate is divided into four.

9. The circularly polarized antenna according to claim 8, wherein said loop-shaped element is formed of a beltlike flexible substrate having mating parts for fixing a bottommost part of said substrate.

10. The circularly polarized antenna according to claim 8, wherein said loop-shaped element is formed of a beltlike metal plate for fixing a bottommost part of said substrate.

11. The circularly polarized antenna according to claim 1, wherein said four elements are divided into two pairs of the two oppositely directed elements, said circularly polarized antenna further comprising a phase differential feeder which sets a phase difference of approximately 90° between currents fed from said feeding points into the individual pairs of the elements.

* * * * *